US010954633B2

(12) United States Patent
Lewis et al.

(10) Patent No.: US 10,954,633 B2
(45) Date of Patent: Mar. 23, 2021

(54) PROCESS FOR MAKING PAPER, PAPERBOARD OR THE LIKE

(71) Applicant: Kemira Oyj, Helsinki (FI)

(72) Inventors: Christopher Michael Lewis, Vancouver, WA (US); William James Garrisi, Camillus, NY (US)

(73) Assignee: Kemira Oyj, Helsinki (FI)

( * ) Notice: Subject to any disclaimer, the term of this patent is extended or adjusted under 35 U.S.C. 154(b) by 73 days.

(21) Appl. No.: 15/776,394

(22) PCT Filed: Sep. 30, 2016

(86) PCT No.: PCT/US2016/054625
§ 371 (c)(1),
(2) Date: May 15, 2018

(87) PCT Pub. No.: WO2018/063271
PCT Pub. Date: Apr. 5, 2018

(65) Prior Publication Data
US 2018/0327974 A1 Nov. 15, 2018

(51) Int. Cl.

| | |
|---|---|
| ***D21H 17/37*** | (2006.01) |
| ***D21H 11/14*** | (2006.01) |
| ***D21H 17/45*** | (2006.01) |
| ***D21H 17/68*** | (2006.01) |
| ***D21H 21/10*** | (2006.01) |
| ***D21H 17/44*** | (2006.01) |

(Continued)

(52) U.S. Cl.
CPC ..... *D21H 23/20* (2013.01); *D21H 11/14* (2013.01); *D21H 11/18* (2013.01); *D21H 17/375* (2013.01); *D21H 17/44* (2013.01); *D21H 17/45* (2013.01); *D21H 17/68* (2013.01); *D21H 21/10* (2013.01); *D21H 21/18* (2013.01); *D21H 21/20* (2013.01)

(58) Field of Classification Search
CPC ..... D21H 17/375; D21H 21/18; D21H 17/37; D21H 21/10; D21H 21/20; D21H 17/45; D21H 17/68; D21H 11/14; D21H 23/76; D21H 17/41; D21H 17/44; D21H 17/63; D21H 17/66; D21H 27/30
See application file for complete search history.

(56) References Cited

U.S. PATENT DOCUMENTS 5,603,805 A * 2/1997 Andersson ..... C01B 33/143 162/168.3
6,379,497 B1 * 4/2002 Sandstrom ..... B65D 1/265 162/123

(Continued)

FOREIGN PATENT DOCUMENTS

| | | |
|---|---|---|
| WO | 2008033490 A1 | 3/2008 |
| WO | 2013179139 A1 | 12/2013 |
| WO | 2016034776 A1 | 3/2016 |

*Primary Examiner* — Jose A Fortuna
(74) *Attorney, Agent, or Firm* — Berggren LLP

(57) ABSTRACT

An improved process for making paper or paper board is provided. The process comprises providing a cellulosic fibre suspension comprising recycled fibre material, and having a conductivity of at least 1.5 mS/cm; and adding a glyoxalated copolymer of acrylamide and cationic monomers and inorganic siliceous microparticles to the fibre suspension, sequentially or simultaneously. Advantages comprise improved productivity of the process, and paper strength.

15 Claims, 14 Drawing Sheets

(51) Int. Cl.

| | |
|---|---|
| ***D21H 23/20*** | (2006.01) |
| ***D21H 21/20*** | (2006.01) |
| ***D21H 21/18*** | (2006.01) |
| ***D21H 11/18*** | (2006.01) |

(56) References Cited

U.S. PATENT DOCUMENTS 7,641,766 B2 * 1/2010 St. John ..... D21H 17/55 162/166
7,981,250 B2 * 7/2011 Polverari ..... D21H 23/14 162/158
8,038,846 B2 * 10/2011 Polverari ..... D21H 23/14 162/158
9,279,217 B2 * 3/2016 Hietaniemi ..... D21H 27/002
9,388,533 B2 * 7/2016 Krapsch ..... D21C 5/02
9,562,327 B2 * 2/2017 Solhage ..... D21H 17/375
9,873,986 B2 * 1/2018 Zhu ..... D21H 21/18
2006/0130991 A1 * 6/2006 Solhage ..... D21H 17/375 162/158
2007/0056706 A1 * 3/2007 Crisp ..... C08G 73/0286 162/164.3
2008/0066880 A1 * 3/2008 Polverari ..... D21H 21/10 162/158
2008/0128102 A1 * 6/2008 Polverari ..... D21H 21/10 162/168.3
2010/0326615 A1 12/2010 Lu
2014/0284011 A1 * 9/2014 Krapsch ..... D21C 5/02 162/168.3
2014/0318727 A1 * 10/2014 Solhage ..... D21H 17/375 162/168.3
2015/0041092 A1 2/2015 Hietaniemi et al.
2016/0222590 A1 * 8/2016 Zhu ..... D21H 21/20
2016/0298297 A1 * 10/2016 Borkar ..... D21H 21/18
2018/0327974 A1 * 11/2018 Lewis ..... D21H 11/14
2019/0271115 A1 * 9/2019 Hamers ..... C12P 19/16

* cited by examiner

Means and Std Deviations

| Level | Number | Mean | Std Dev | Std Err Mean | Lower 95% | Upper 95% |
|---|---|---|---|---|---|---|
| GPAM 1 + NTS PAE + Silica 3 | 82 | 2373.13 | 18.6109 | 2.0552 | 2369.0 | 2377.2 |
| GPAM 1 + NTS PAE + Silica 5 | 85 | 2330.29 | 53.3677 | 5.7885 | 2318.8 | 2341.8 |

Means and Std Deviations

| Level | Number | Mean | Std Dev | Std Err Mean | Lower 95% | Upper 95% |
|---|---|---|---|---|---|---|
| GPAM 1 + Silica 3 | 13789 | 698.00 | 303.474 | 2.5844 | 692.9 | 703.1 |
| GPAM 1 + Silica 5 | 1529 | 1120.71 | 13.594 | 0.3476 | 1120.0 | 1121.4 |

Means and Std Deviations

| Level | Number | Mean | Std Dev | Std Err Mean | Lower 95% | Upper 95% |
|---|---|---|---|---|---|---|
| GPAM 1 + NTS PAE + Silica 3 | 14372 | 0.058132 | 0.009356 | 7.8e-5 | 0.05798 | 0.05829 |
| GPAM 1 + NTS PAE + Silica 5 | 1530 | 0.075874 | 0.004734 | 0.00012 | 0.07564 | 0.07611 |

Missing Rows 1127

Means and Std Deviations

| Level | Number | Mean | Std Dev | Std Err Mean | Lower 95% | Upper 95% |
|---|---|---|---|---|---|---|
| GPAM 1 + Silica 3 | 26403 | 679.46 | 294.030 | 1.8095 | 675.9 | 683.0 |
| GPAM 1 + Silica 5 | 2351 | 1075.28 | 48.808 | 1.0066 | 1073.3 | 1077.3 |

Means and Std Deviations

| Level | Number | Mean | Std Dev | Std Err Mean | Lower 95% | Upper 95% |
|---|---|---|---|---|---|---|
| GPAM 1 + Silica 3 | 27530 | 0.056842 | 0.008302 | 0.00005 | 0.05674 | 0.05694 |
| GPAM 1 + Silica 5 | 2351 | 0.069426 | 0.005164 | 0.00011 | 0.06922 | 0.06964 |

Means and Std Deviations

| Level | Number | Mean | Std Dev | Std Err Mean | Lower 95% | Upper 95% |
|---|---|---|---|---|---|---|
| GPAM 1 | 200 | 202837 | 54.0181 | 3.820 | 2020.8 | 2035.9 |
| GPAM 1 + Silica 3 | 34 | 2085.14 | 50.6148 | 8.680 | 2067.5 | 2102.8 |
| GPAM 2 + Silica 3 | 25 | 2123.76 | 52.8166 | 10.563 | 2102.0 | 2145.6 |

Means and Std Deviations

| Level | Number | Mean | Std Dev | Std Err Mean | Lower 95% | Upper 95% |
|---|---|---|---|---|---|---|
| GPAM 1 | 200 | 102.670 | 4.39991 | 0.3111 | 102.06 | 103.28 |
| GPAM 1 + Silica 3 | 34 | 103.318 | 3.51981 | 0.6036 | 102.09 | 104.55 |
| GPAM 2 + Silica 3 | 25 | 108.495 | 5.54534 | 1.1091 | 106.21 | 110.78 |

PROCESS FOR MAKING PAPER, PAPERBOARD OR THE LIKE

PRIORITY

This application is a U.S national application of PCT-application PCT/US2016/054625 filed on Sep. 30, 2016, the contents of all of which are incorporated herein by reference.

FIELD OF THE ART

The present disclosure relates to improved processes for making paper, paperboard or the like from a cellulosic fibre suspension comprising recycled fibre material, employing a specific chemical additive system.

BACKGROUND

During a typical papermaking process, a cellulosic fibre suspension having relatively high consistency, the so-called thick stock, is diluted with white water or other circulating waters into thin stock, then delivered to a headbox, drained on a moving screen (often referred to as a machine wire) to form a wet web, which is then pressed and dried, in a press section and dryer section, respectively. It is known to add chemical additives for increasing retention of the fibres and other substances such as filler, and also for improving the dewatering rate on the machine wire and in the press section. Furthermore, chemical additives have been used to enhance the paper and paper board end use properties, with a focus on the strength properties.

A typical additive system for retention and drainage used in papermaking comprises flocculating the fibre suspension by addition of high molecular weight (HMW) polyacrylamide, of either cationic or anionic charge, shearing the flocs, and reflocculating the sheared flocs by addition of inorganic siliceous microparticles such as silica or bentonite to the fibre suspension.

Due to the increased environmental awareness and regulations, papermaking processes have become more and more closed using less fresh water, resulting in increased conductivity or total ionic strength, i.e. salt concentration, in the fibre suspension. Concurrently, the recycled fibre content has increased as a fibre source in the papermaking. The fibres obtained from the recycled fibre material may have undergone several rounds of recycling, which deteriorates the intrinsic strength of the fibre and general quality such as fibre length, thereby deteriorating end use properties of the paper, particularly the strength. Reduced intrinsic strength can increase risk of paper web breakages, negatively impacting productivity and overall process efficiency. One common measure to compensate strength loss is to increase the refining level of the fibre material. The goal of increasing the refining is to 'develop' by increasing the functional area exposing more carboxyl groups, thereby increasing the fibres ability to create more hydrogen bonds with other cellulosic fibres and cellulosic fines and subsequently increasing the strength. This operation results in a decrease in Canadian Standard Freeness (CSF) which is a measure of pulp drainage. Lower CSF slows down the drainage rate, and the weak recycled fibres have a limited response to the additional refining. The fibre length of recycled fibre will decrease sharply after a limited amount of refining, resulting in a reduction of various strength properties. Alternatively, anionic strength additives such as CMC or low molecular weight anionic polyacrylamide, may be added to the fibre suspension, but also this often leads to a decrease in the drainage rate, which increases the drying demand of the paper or paperboard, requiring an increase in steam consumption in the dryer section. Steam availability is limited in the paper production facility. Consequently, drying demand of the paperboard is often a rate limiting step with respect to productivity rates. In worst case the lower strength of the paper web may demand lower machine speed and subsequent production rates to mitigate paper web failures on the paper machine.

In addition to low quality fibres, recycled fibre materials may introduce significant levels of detrimental substances to the papermaking process. This can include ash originating from coating pigments, starch, sizing agents, dissolved and colloidal substances. These substances carried over to the papermaking process may further increase the overall colloidal load and conductivity of the fibre suspension, accumulating in the process water circuit. These materials can cause plugging and deposits on the equipment and produced paper.

It has been observed that the performance of the conventional drainage and retention concepts using HMW polyacrylamides of cationic or anionic charge, decreases when used in fibre suspensions having elevated conductivity, and dissolved and colloidal substances. The loss of polymer performance leads to decreases in drainage, retention of fibre and fibre fines, and press dewatering, which increases the drying demand of the paper, limiting paper machine productivity. While this kind of fibre suspensions and conditions would require higher dosages of the HMW polyacrylamide, increasing the dosage does not address the issue fully. HMW polyacrylamide cannot be increased infinitely without eventually over-flocculating the fibre suspension which reduces press dewatering rates and causes poor formation, reducing productivity and strength, respectively.

Low molecular weight (LMW), typically of below 700 000 g/mol, high charge density polymers have been used to improve dewatering and pressing efficiency in certain paper grades, either alone or together with the HMW cationic polyacrylamide using concepts. However these polymers are limited in their ability to maintain retention without increasing dosages, which may lead into over-cationization of the process. Providing the desired retention, strength and drainage properties with a 3-component system comprising the LMW high charge density polymer, HMW cationic polyacrylamide, and siliceous microparticles is difficult to control, adds complexity to the process, and may still be unable to provide the desired paper properties and productivity in the challenging conditions of high conductivity, poor fibre quality and increased load of e.g. ash, starch, size, dissolved and colloidal substances.

Thus there is a constant need for chemical additive systems providing improved productivity to the papermaking process, and tolerating elevated conductivity without substantial performance loss.

SUMMARY

The object of the present invention is to minimize or even eliminate the disadvantages existing in the prior art when using elevated amounts of recycled fibre material.

According to a first aspect of the present invention, a process for making paper, paperboard of the like characterized by what is presented in the independent claim, is provided.

Typical process according to the invention for making paper, paperboard or the like comprises providing a cellulosic fibre suspension; optionally diluting the fibre suspension; delivering the fibre suspension to a headbox, draining the fibre suspension on a screen to form a wet web of paper, paperboard, or an individual ply thereof, optionally combining the individual ply with other plies being formed simultaneously, pressing and drying the wet web to obtain the paper or paperboard; wherein the cellulosic fibre suspension comprises at least 40% on dry weight basis, based on the paper, paperboard or the individual ply thereof, of recycled fibre material, and has a conductivity of at least 1.5 mS/cm as measured at the headbox of the paper, paperboard or the individual ply thereof; and wherein a glyoxalated copolymer of acrylamide and cationic monomers, and inorganic siliceous microparticles are added to the fibre suspension sequentially or simultaneously.

An advantage of the process according to the present disclosure is that an improved productivity may be obtained even when using substantial amounts of low quality recycled fibre material and fibre suspension having an elevated conductivity, without substantial performance loss of the chemical additive system, which comprises glyoxalated copolymer of acrylamide and cationic monomers (hereinafter also referred to as a cationic GPAM or just GPAM), and inorganic siliceous microparticles.

Another advantage of the process according to the present disclosure is that improved paper strength may be obtained even when using substantial amounts of low quality recycled fibre material while providing easy repulpability.

Yet another advantage of the process according to the present disclosure is that an improved dewatering on the wire and especially in the press may be obtained, thereby enabling steam i.e. energy savings and/or increased productivity.

Yet another advantage of the process according to the present disclosure is that as the chemical additive system of the present disclosure tolerates elevated conductivities without substantial performance loss, the water circulation at the paper mill may be closed i.e. the amount of added fresh water may be kept lower thereby decreasing the environmental burden of the papermaking process.

Further advantages of the invention are described and exemplified in the following Figures and Detailed Description.

BRIEF DESCRIPTION OF THE FIGURES

The accompanying drawings, which are included to provide a further understanding of the invention and constitute a part of this specification, illustrate certain embodiments of the invention and together with the description help to explain the principles of the invention. In the drawings.

DETAILED DESCRIPTION

Figure 1:
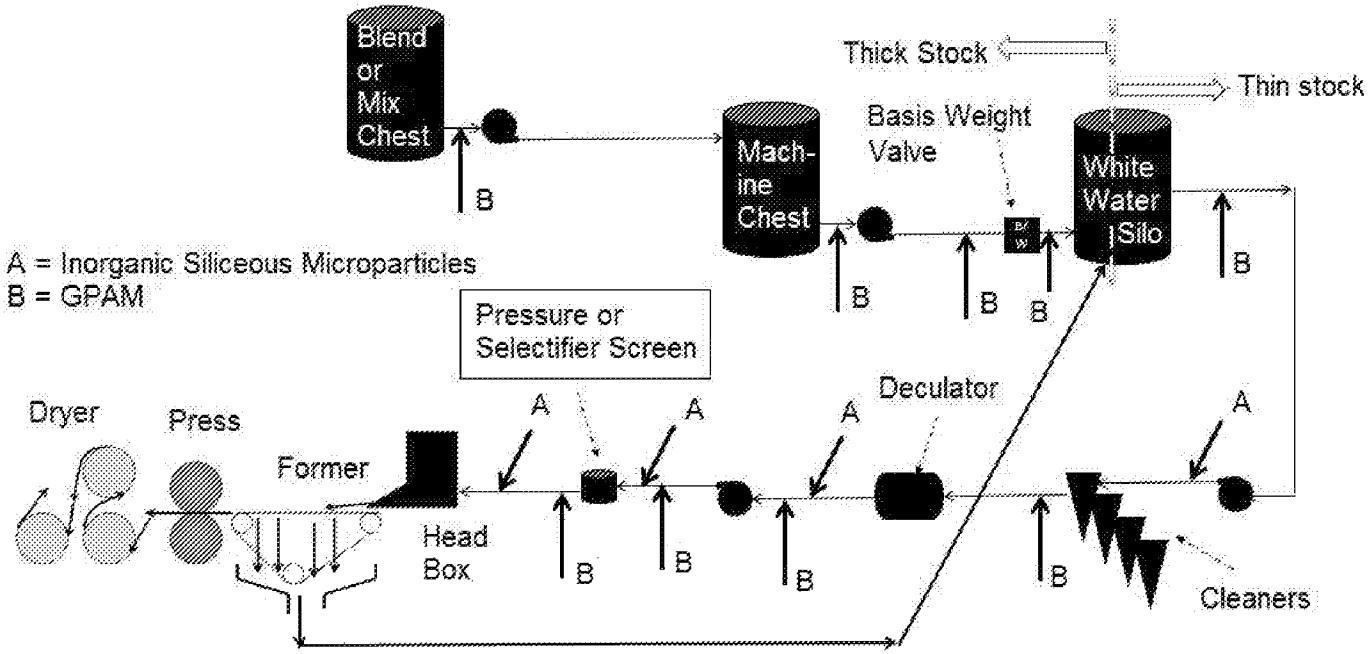
FIG. 1 is a schematic diagram of a papermaking process illustrating where the components of the chemical additive system (A representing inorganic siliceous microparticles and B representing the glyoxalated copolymer of acrylamide and cationic monomers) may be added in the paper and paperboard making process of the present disclosure.

The present disclosure is directed to the unexpected discovery that in the manufacture of paper or paperboard products using at least 40% of recycled fibre material and manufactured under elevated conductivity, productivity may be significantly improved by the use of a cationic GPAM in combination with siliceous inorganic microparticles, preferably in combination with silica sol.

The disadvantages of increased load of ash, starch, size, dissolved and/or colloidal substances etc. originating from the recycled fibre material and carried over to the process of the present disclosure, and the disadvantages of the deteriorated fibre quality, can be minimized or even eliminated by using the present additive system providing improved paper strength, retention and drainage, especially press dewatering, and thereby substantially increasing the productivity of the papermaking process. This may be achieved even when the conductivity of the cellulosic fibre suspension is elevated due to, for example, closed water system, i.e. in a papermaking process where the amount of effluent exiting the mill has been decreased, even to zero and the only fresh water used is to replace process water lost by evaporation. By the present additive system the drainage performance may be improved, or at least the loss of drainage performance may be eliminated or reduced, and the steam consumption reduced or maintained during draining, pressing and drying. At the same time the present additive system improves strength, especially dry strength, of the paper, paperboard or the like. Improved strength, in combination with the steam savings, enables higher paper machine speed with lower paper web breakage risk, thereby increasing machine efficiency and improving productivity. By the present additive system also the retention performance may be increased, or at least the loss of retention performance may be eliminated or reduced, which is beneficial especially due to the higher load of dissolved and colloidal substances, ash etc. originating from the recycled fibre material. Increased retention control improves productivity, reducing the risk for deposits and paper web breakages, and reduces furnish cost as fibres, fines and colloids, fillers and other additives are more efficiently retained into the paper web. Increased retention reduces other additive costs and decreases the detrimental substance load in the water loop which improves the water loop quality, reducing the water treatment demand. Furthermore, the dosages of the cationic GPAM of the present additive system may be increased far beyond the dosages of commonly used HMW CPAM or high charge fixatives without causing over-flocculation or over-cationization of the fibre suspension, so that desired process and/or product specifications such as steam consumption and strength may be obtained.

As used herein, the terms paper, paperboard, paper or paperboard product (these terms can be used interchangeably herein) are understood to include a sheet material that contains papermaking fibres, and which may also contain other materials. Suitable fibre materials to be used in the present process include natural and synthetic fibres, for example, cellulosic fibres obtained by chemical pulping, such as kraft or sulfite pulping, semichemical pulping, or mechanical pulping; bleached or unbleached fibres; wood or non-wood fibres; fibres derived from recycled paper; synthetic fibres; waste activated sludge (WAS); reclaimed fibre sludge; and any mixtures thereof. As used herein, the terms fibre web and paper web are understood to include both forming and formed paper sheet materials.

The process of the present disclosure is suitable for the manufacture of simple fibre webs and multiplies paperboard products. Depending on the application, the number of fibrous substrates in a paper or paperboard product can vary. The paper product can have more than one fibrous substrate. In one embodiment, the paper product has two or more fibrous substrates, e.g., a two-ply or multi-ply paper product. Each of the plies of a multi-ply product may have different properties and may be formed from cellulose fibre suspensions having different amounts of recycled fibre materials and conductivities.

The process of the present disclosure may be used for the manufacture of various paper grades using recycled fibre material, such as, but not limited to kraft paper, liner board, medium, test liner, fluting, sack paper, white lined chipboard, gypsum board, coated recycled board, core board or folding boxboard.

According to an embodiment of the invention, the recycled fibre material is selected from old corrugated cardboard, mixed office waste, double liner kraft, or any mixtures thereof. By old corrugated cardboard (OCC) is meant a material comprising corrugated containers having liners of test liner, jute or kraft, and it may cover also double sorted corrugated cardboard (DS OCC). By mixed office waste (MOW) is meant a material mainly containing xerographic papers and offset papers. By double lined kraft is meant a material comprising clean sorted unprinted corrugated cardboard cartons, boxes, sheet or trimmings, e.g. of kraft or jute liner. Presence of any of these in the cellulosic fiber material decrease drainage and paper strength, and provide a substantial load of dissolved and colloidal substances to the process, interfering with the performance of any cationic retention and dry-strength agents, and wet-strength resins, as well as causing deposits. Conventionally increased washing has been used to reduce colloidal substances, however this operation is not desired nor typically available in closed systems.

According to an embodiment of the invention, the cellulosic fibre suspension may comprise at least 50%, preferably at least 60%, on dry weight basis, based on the paper, paperboard or the individual ply thereof, of the recycled fibre material. The additive concept of the present disclosure performs when using high amounts of recycled fibre materials, even up to 100%.

As understood by a skilled person, the conductivity of a fibre suspension may fluctuate to some extent when a papermaking process is operated due to various reasons, for example due to fluctuation in the raw material quality or degree of water closure i.e. level of fresh water make-up to replace exiting effluent. By conductivity, as used herein, is meant the conductivity of the cellulose fibre suspension as measured at any point of time of normal operating conditions at the headbox of the paper, paperboard or the individual ply thereof. As a way of an example, by a process for making paper or paperboard, wherein the cellulosic fibre suspension has a conductivity of at least 1.5 mS/cm, is meant a papermaking process operating at conductivity of at least 1.5 mS/cm as measured at any point of time of normal operating conditions at the headbox of the paper, paperboard or the individual ply thereof. In other words, situations of malfunction, operation shutdown or start-up, when the conductivity may differ significantly from the conductivity of the normal operating conditions, are excluded.

According to an embodiment of the invention, the cellulosic fibre suspension may have a conductivity of at least 2.0 mS/cm, as measured at the headbox of the paper, paperboard or the individual ply thereof. The additive system of the present disclosure tolerates elevated, high, or even very high conductivity. In other words the elevated conductivity does not lead into substantial decrease of strength, retention and drainage improving effect of the present additive system. In an embodiment according to the invention, the cellulosic fibre suspension may have a conductivity of at least 3.0 mS/cm, or at least 4.0 mS/cm, or even at least 5.0 mS/cm, as measured at the headbox of the paper, paperboard or the individual ply thereof. As used herein, the expression "as measured at the headbox of the paper, paperboard or the individual ply thereof" has its ordinary meaning in the field. Typically the conductivity is measured from the fibre suspension of the short circulation, after the addition of last additive, or from the recirculation water stream of the headbox.

Glyoxalated cationic copolymer of acrylamide and cationic monomers, commonly known as GPAM, is a well-known strength resin that is often regarded as benchmark for generating dry strength or temporary wet strength. The polyacrylamide basepolymer is typically manufactured by polymerizing acrylamide and cationic monomers, e.g. diallyldimethyl ammonium chloride (DADMAC), rendering the polymer self-retaining on fibers. GPAM is a reactive polymer that can covalently bind with cellulose upon dehydration thereby providing high dry strength, as well as initial wet strength, to the paper. The reaction with cellulose is reversible in water, making the wet strength temporary, thereby not affecting repulpability of the paper.

Generally a cationic GPAM is prepared by reacting glyoxal with a cationic polyacrylamide basepolymer, i.e. copolymer of acrylamide and cationic monomers, in slightly alkaline aqueous solution and stabilizing under acidic conditions. This method is well known to a person skilled in the art. The amount of the glyoxal can vary with application and may be from about 10% to about 100%, or from about 40% to about 50%, based on the total weight of the basepolymer.

The cationic GPAM, or glyoxalated copolymer of acrylamide and cationic monomers, as used herein, refers to medium molecular weight GPAM products having cationic charge densities over about 0.2 meq/g (dry basis) as measured by Mutek charge titration at pH 4.0, which is a well-known method to a skilled person. The minimum level is needed for providing sufficient retention of the cationic GPAM to the fibres, and optionally other anionic materials in the fibre suspension. According to an embodiment of the invention, the cationic charge density is in the range of about 0.2-5.0 meq/g. In other embodiment, the cationic charge density may be in the range of about 0.2-4.0 meq/g. According to one preferred embodiment of the invention, the cationic charge density is in the range of about 0.2-3.5 meq/g. In embodiments having particularly high polymer retention a so-called high charge density cationic GPAM is used, wherein the cationic charge density is over about 0.8 meq/g, preferably over about 1.0 meq/g. In embodiments having particularly high polymer retention, yet sufficiently low charge density of the cationic GPAM to facilitate high dosages to achieve the desired strength level without over-cationizing the process, as the case may be for example in papermaking processes using high amounts of weak recycled fibre materials, the cationic charge density is in the range of about 0.8-3.0 meq/g, preferably in the range of 1.0-2.0 meq/g, and more preferably between 1.2 and 1.8 meq/g. In these embodiments even higher retention may be achieved and even higher dosages may be applied to achieve the desired strength without the risk of over-cationizing the process. Additionally it was observed that cationic GPAM having this charge density provided especially good retention of colloidal substances.

The cationic polyacrylamide basepolymer of the GPAM comprises units originating from cationic monomers and acrylamide monomers. It should be understood that correspondence between the amount of the cationic monomers used in the manufacture of the basepolymer, expressed as mol-% or as weight-%, and the charge density of the final GPAM, depends e.g. on the molecular weight of the cationic monomer and the degree of glyoxylation. The following exemplary amounts of the cationic monomers used in the manufacture of the cationic polyacrylamide basepolymer provide the desired charge densities, especially when the monomer is diallyl dimethyl ammonium chloride (DADMAC). In embodiments, the amount of the cationic monomers in the manufacture of the basepolymer is above about 3 mol-% based on the total moles of polymerizable monomers. According to an embodiment of the invention, the amount of the cationic monomers is in the range of about 3-65 mol-%, or about 3-45 mol-%. According to other embodiment, the amount of the cationic monomers may be in the range of about 3-40 mol-%. In embodiments having particularly high polymer retention a so-called high charge density cationic GPAM is used, wherein the amount of the cationic monomers in the manufacture of the basepolymer is over about 8 mol-%, preferably over about 10 mol-%. In embodiments having particularly high polymer retention, yet sufficiently low charge density of the cationic GPAM to facilitate high dosages to achieve the desired strength level without over-cationizing the process, as the case may be for example in papermaking processes using high amounts of weak recycled fibre materials, the amount of the cationic monomers is in the range of about 8-32 mol-%. In embodiments having even higher retention and facilitating even higher dosages, the amount of the cationic monomers is in the range of about 10-20 mol-%, preferably about 11-17 mol-%. The cationic polyacrylamide basepolymer may comprise only one type of cationic monomers, or it may comprise more than one type of cationic monomers.

According to an embodiment of the invention, the amount of acrylamide monomer used in the manufacture of the cationic polyacrylamide basepolymer is below about 97 mol-% based on the total moles of polymerizable monomers. According to an embodiment of the invention, the amount of acrylamide monomer may be in the range of about 97-35 mol-%, or about 97-55 mol-%. In some embodiments, the amount of acrylamide monomer may be in the range of about 97-60 mol-%. According to an embodiment of the invention, the amount of acrylamide monomer is below about 92 mol-%, or below about 90 mol-%. According to an embodiment of the invention, the amount of acrylamide monomer may be in the range of about 92-68 mol-%. In some embodiments, the amount of acrylamide monomer may be in the range of about 90-80 mol-%, or about 89-83 mol-%. The acrylamide may be acrylamide or another primary amine-containing monomer, such as methacrylamide, ethylacrylamide, N-ethyl methacrylamide, N-butyl methacrylamide, or N-ethyl methacrylamide, or combinations thereof.

The cationic monomer may be any suitable cationic monomer generally used in such cationic GPAMs. General examples of cationic monomers include allyl amine, vinyl amine, dialkylaminoalkyl acrylates and methacrylates and their quaternary or acid salts, including, but not limited to, dimethylaminoethyl acrylate methyl chloride quaternary salt (DMAEA.MCQ), dimethylaminoethyl acrylate methyl sulfate quaternary salt, dimethyaminoethyl acrylate benzyl chloride quaternary salt, dimethylaminoethyl acrylate sulfuric acid salt, dimethylaminoethyl acrylate hydrochloric acid salt, dimethylaminoethyl methacrylate methyl chloride quaternary salt, dimethylaminoethyl methacrylate methyl sulfate quaternary salt, dimethylaminoethyl methacrylate benzyl chloride quaternary salt, dimethylaminoethyl methacrylate sulfuric acid salt, dimethylaminoethyl methacrylate hydrochloric acid salt, dialkylaminoalkylacrylamides or methacrylamides and their quaternary or acid salts such as acrylamidopropyltrimethylammonium chloride, dimethylaminopropyl acrylamide methyl sulfate quaternary salt, dimethylaminopropyl acrylamide sulfuric acid salt, dimethylaminopropyl acrylamide hydrochloric acid salt, methacrylamidopropyltrimethylammonium chloride, dimethylaminopropyl methacrylamide methyl sulfate quaternary salt, dimethylaminopropyl methacrylamide sulfuric acid salt, dimethylaminopropyl methacrylamide hydrochloric acid salt, diethylaminoethylacrylate, diethylaminoethylmethacrylate, diallyldiethylammonium chloride. Alkyl groups may be C1-4 alkyl.

According to an embodiment of the invention, the cationic monomer is selected from diallyl dimethyl ammonium chloride (DADMAC), 2-vinylpyridine, 4-vinylpyridine, 2-methyl-5-vinyl pyridine, 2-vinyl-N-methylpyridinium chloride, p-vinylphenyltrimethylammonium chloride, p-vinylbenzyltrimethylammonium chloride, 2-(dimethylamino) ethyl methacrylate, trimethyl(p-vinylbenzyl)ammonium chloride, p-dimethylam inoethylstyrene, dimethylaminopropyl acrylamide, 2-methylacroyl-oxyethyltrimethyl ammonium methylsulfate, 3-acrylamido-3-methylbutyl trimethyl ammonium chloride, 2-(dimethylamino)ethyl acrylate, [2-(acrylamido)ethyl]trimethylammonium chloride, [2-(methacrylamido)ethyl]trimethylammonium chloride, [3-(acrylamido)propyl]-trimethylammonium chloride, [3-(methacrylamido)propyl]-trimethylammonium chloride, N-methyl-2-vinylpyridinium, N-methyl-4-vinylpyridinium, [2-(acryloyloxy)ethyl]trimethylammonium chloride, [2-(methacryloyloxy)ethyl]-trimethylammonium chloride, [3-(acryloyloxy)propyl]-trimethylammonium chloride, [3-(methacryloyloxy)propyl]trimethylammonium chloride, and combinations thereof. According a preferred embodiment of the invention the monomer is diallyl dimethyl ammonium chloride (DADMAC).

According to an embodiment of the invention, the polyacrylamide basepolymer, i.e. the copolymer of acrylamide and cationic monomers, comprises units originating from multifunctional crosslinking monomers. In other words, the basepolymer may be prepared by polymerizing a monomer mixture comprising acrylamide, cationic monomers and multifunctional crosslinking monomers. In these embodiments, the basepolymer itself is structured or branched, and as the glyoxalation provides a second level of structuring, the final GPAMs made in this way have what is described as a double structure. The structuring or branching of the basepolymer may enable higher molecular weight of the GPAM, which may improve strength performance in papermaking. The structuring or branching of the basepolymer may also effect the degree of glyoxalation and thereby, the GPAM performance. As used herein, the term "multifunctional crosslinking monomer component" includes bifunctional monomers as well as multifunctional monomers. Examples of suitable monomers include, but are not limited to, methylenebisacryl-amide; methylenebismethacrylamide; triallylammonium chloride; tetraallylammonium chloride; polyethyleneglycol diacrylate; polyethyleneglycol dimethacrylate; N-vinyl acrylamide; divinylbenzene; tetra (ethylene glycol) diacrylate; dimethylallylaminoethylacrylate ammonium chloride; diallyloxyacetic acid, Na salt; diallyloctylamide; trimethylolpropane ethoxylate triacrylate; N-allylacrylamide N-methylallylacrylamide, and combinations thereof. The amount of the multifunctional crosslinking component may vary. In embodiments, the amount of crosslinking monomer is at least about 20 ppm, e.g., from about 20 to about 20 000 ppm, or from about 100 to about 1000 ppm, based on the total weight of the polymer. Examples of suitable multifunctional crosslinking monomers, suitable structured or branched cationic polyacrylamides, and suitable glyoxalated structured or branched cationic polyacrylamides may be found in WO 2006/016906, the entire disclosures of which is hereby incorporated by reference herein.

According to an embodiment of the invention, a chain transfer agent may be used as an optional component in the polymerization of the monomer mixture comprising acrylamide, cationic monomers and optionally multifunctional crosslinking monomers. Examples of suitable transfer agents are selected from the group consisting of 2-mercaptoethanol; lactic acid; isopropyl alcohol; thioacids; and sodium hypophosphite. The amounts of the chain transfer agent may vary. Generally, such a chain transfer agent is present in an amount from about 0 to about 15%, in some embodiments from about 0 to about 10% by weight of the copolymer.

The expressions copolymer of acrylamide and cationic monomers, or cationic polyacrylamide basepolymer, as used herein, may also cover cationic copolymers prepared by polymerizing acrylamide and an N-vinylamide, such as N-vinylformamide, and at least partially hydrolysing the N-vinylamide monomer moiety to a vinylamine. Additionally the expressions copolymer of acrylamide and cationic monomers, or cationic polyacrylamide basepolymer, as used herein, may also cover cationic copolymers prepared by partial Hoffman degradation of a polyacrylamide.

If the molecular weight of the cationic GPAM is either very high or very low, the desired performance in the papermaking process as well as the desired paper properties such as strength may not be achieved. The molecular weight of the cationic polyacrylamide basepolymer before glyoxalation has a major contribution to the molecular weight of the final GPAM. According to an embodiment of the invention, the cationic polyacrylamide has a molecular weight in the range of 500-1 000 000 Daltons, or in the range of 1 000-100 000 Daltons. In some embodiments according to the invention, the cationic polyacrylamide may have a molecular weight in the range of 2 000-50 000 Daltons, in the range of 3 000-40 000 Daltons, or in the range of 5 000-30 000 Daltons.

According to an embodiment of the invention, the cationic GPAM has a weight-average molecular weight of at least 1 000 000 g/mol, preferably in the range of 1 000 000-5 000 000 g/mol. Polymers having this molecular weight range belong to the so-called medium molecular weight polymers. Methods for measuring the weight-average molecular weight are well known by a skilled person, for example gel-permeation chromatography (GPC), may be used. In these embodiments good strength, drainage and retention improvements are obtained. The relative mass of the cationic GPAM may also be characterized by the intrinsic viscosity of the polymer, which has a relation to the molecular weight. Thus in embodiments, the cationic GPAM has an intrinsic viscosity of at least 0.2 dl/g.

In the present disclosure the inorganic siliceous microparticles may be silica sols, colloidal silica, silica based particles, silica microgels, silica gels, polysilicates, aluminosilicates, polyaluminosilicates, borosilicates, polyborosilicates, zeolites, swellable clay such as bentonite, e.g. sodium bentonite, calcium bentonite or magnesium bentonite, or any combinations thereof. The inorganic siliceous microparticles may comprise hectorite, smectites, montmorillonites, nontronites, saponite, sauconite, hormites, attapulgites, laponite, sepiolites, or any combination thereof. As used herein, by microparticles are meant particles having at least one dimension in micro or nano scale.

According to an embodiment of the invention, the inorganic siliceous microparticles comprise bentonite.

According to a preferred embodiment of the invention, the inorganic siliceous microparticles comprise silica sol. These embodiments may provide improved retention, especially of colloidal substances, and drainage, compared to other inorganic siliceous microparticles.

Silica sols may be characterized by their surface area and/or level of aggregation or structuring. High SSA and structured or aggregated silica dispersions are beneficial in applications where flocculation is desirable. The degree of aggregation is normally characterized by the S-value, which is a measure of the silica (as percent) in the disperse phase. The silica sols may be unmodified or e.g. surface modified, for example by aluminum, boron, or phosphate.

According to an embodiment of the invention, the silica sol has either an S-value less than 40%, preferably less than 3 5%, or a specific surface area of at least 800 $m^2/g$, preferably at least 900 $m^2/g$. These embodiments may provide further improved retention, and drainage compared to silica sols with higher S-values or lower specific surface areas. According to an embodiment of the invention, the silica sol has both an S-value less than 40% and a specific surface area of at least 800 $m^2/g$, preferably the S-value is less than 35% and the specific surface area is at least 800 $m^2/g$ or at least 900 $m^2/g$. These embodiments may provide even further improved retention, and drainage compared to silica sols with either the S-value or the specific surface area outside said ranges.

The cationic GPAM and inorganic siliceous microparticles may be introduced to the cellulose fibre suspension throughout the paper making process prior to the headbox. According to an embodiment of the invention, the cationic GPAM and the inorganic siliceous microparticles are introduced into the cellulosic fibre suspension sequentially. According to other embodiment of the invention, the cationic GPAM is added to the fibre suspension before the addition of the inorganic microparticles. In these embodiments the cationic GPAM has more time to adsorb onto the fibres before delivering to the headbox and the commencement of sheet forming, thereby providing higher strength improvement to the paper. Preferably, the cationic GPAM is added to the fibre suspension prior to the addition of the inorganic microparticles.

Typically, a fibre suspension having a consistency of above 20 g/l is called thick stock, before it is diluted with white water into thin stock. In embodiments, the cationic GPAM is added to the fibre suspension having a consistency of above 20 g/I. In these embodiments the cationic GPAM has not only more time to adsorb onto the fibres, but also is in closer proximity with the fibres due to the higher consistency, thereby providing opportunity for greater interaction, which provides a strength improvement to the paper.

Addition sequences may also include GPAM application after the inorganic siliceous microparticles. According to an embodiment of the invention, the cationic GPAM and the inorganic siliceous microparticles may also be introduced into the cellulosic fibre suspension simultaneously. When introduced simultaneously, the components may be kept separate before addition, i.e. the addition is simultaneously but separate. In some embodiments, the inorganic siliceous microparticles and the cationic GPAM are introduced both sequentially and simultaneously.

The process according to an embodiment of the invention may further comprise adding a high molecular weight (HMW) cationic flocculant to the fibre suspension, wherein the HMW cationic flocculant comprises a copolymer of acrylamide and cationic monomers. The HMW cationic flocculant may be linear or branched. The acrylamide and cationic monomers, in case of branching the multifunctional crosslinking monomers, may be the same as disclosed above for the polyacrylamide basepolymer of the cationic GPAM.

In a specific embodiment of the paper or paperboard manufacturing process a GPAM is introduced to the cellulosic fibre suspension, then a HMW CPAM flocculant is introduced, followed by inorganic siliceous microparticles.

The process according to an embodiment of the invention may further comprise adding an anionic acrylamide based flocculant to the fibre suspension, wherein the anionic acrylamide based flocculant comprises a copolymer of acrylamide and acrylic acid, a homopolymer of acrylic acid, a polyacrylamide subjected to alkaline partial or full hydrolysis, or any combinations thereof. The anionic acrylamide based flocculant may be linear or branched.

In embodiments, addition of the cationic GPAM and/or further flocculants flocculates the cellulosic fibre suspension. The formed flocs are subjected to varying degrees of mechanical stress degrading the floc structure along the papermaking process caused by shear forces associated with the fluid flow in the approach piping or shear-inducing equipment such as pumps e.g. fan-pump, and screens e.g. pressure or selectifier screens, herein called as shear stages. The components of the present additive system may be introduced in any order before or after any or all of the shear stages. Preferred addition points of the cationic GPAM and the inorganic siliceous microparticles are presented in FIG. 1.

Short chain or low molecular weight (LMW) high charge polymers allow for the fixation or patch retention of fibre fines, fillers and colloidal particles with the reduction of surface charge. The limitation of low molecular weight (short chain) coagulants is the inability to provide sufficient gross retention without excessive dosages. Dosages necessary to control the level of detrimental substances can push the charge of the wet end to the isoelectric point, reducing the effectiveness of the natural retention mechanism. A decline in retention occurs, resulting in poor runnability and a drop in sheet quality. Flocs formed via patch mechanism are able to reflocculate very efficiently after exposure to shear forces.

High molecular (HMW) weight long chain polymers are low charged and are generally linear, although branched or structured versions are sometimes used. Flocculation with HMW polymers is achieved via the so-called bridging mechanism, wherein the tails and loops of the HMW polymer extend between fibre and particle surfaces. They are efficient for gross retention, however the floc structure allows for a substantial level of "bound" water within the floc often hindering the pressing efficiency of the sheet, which can negatively impact productivity. Flocs formed via bridging mechanism have a low level of reflocculation after high shear.

Without wishing to be bound by any theory it is believed that the cationic GPAM of the present additive system provides higher degree of interaction with the fibres and other particles in the fibre suspension, compared to other polymers used for flocculation. It is believed that flocculation by GPAM proceeds by an enhanced patch flocculation mechanism wherein the medium molecular weight GPAM provides enhanced extension of the polymer from the fibre/particle surface, and thus wider flocculation region. Yet the molecular weight of the GPAM is low enough so that even high shear forces do not substantially degrade the polymer, and reflocculation is readily obtained by addition of inorganic siliceous microparticles. It is believed that in embodiments where the cationic GPAM is obtained by glyoxalating a copolymer of acrylamide, cationic monomers and multifunctional crosslinking monomers, and thus has a double structure, improved performance may require reflocculation with high performing inorganic siliceous microparticles, such as silica sols with either high surface area of at least 900 $m^2/g$ or low S-value of less than 35%, preferably silica sols with high surface area of at least 900 $m^2/g$ and low S-value of less than 35%. In embodiments where the cationic GPAM has high charge density, i.e. over about 0.8 meq/g, such as over about 1.0 meq/g, improved performance may be obtained by using any inorganic siliceous microparticles, especially using silica sols with any surface area and S-value. It is believed that the polymer conformation on the fibre and particle surfaces is especially beneficial in embodiments wherein the cationic GPAM has a charge density of between 1.0 and 2.0 meq/g, especially between 1.2 and 1.8 meq/g.

According to an embodiment of the invention, the glyoxalated copolymer of acrylamide and cationic monomers is added to the fibre suspension as a blend with a polyamidoamine epihalohydrin (PAE). These embodiments further provide improved strength performance, compared to using cationic GPAM alone. In preferred embodiments, the polyamidoamine epihalohydrin is a non-thermosetting polyamidoamine epichlorohydrin having a molar ratio of epi:secondary amine in the range of 0.01-0.8, preferably in the range of 0.01-0.5. Due to the relatively low epi content the non-thermosetting polyamidoamine epichlorohydrin primarily provides dry strength to the paper being produced, without essential increase in permanent wet strength. The weight ratio of cationic GPAM:non-thermosetting polyamidoamine epihalohydrin may be from 1:1 to 100:1, such as 1:1 to 10:1, or 2:1 to 5:1. These embodiments further assist in maintaining repulpability of the paper being produced.

According to embodiments of the invention, still further papermaking additives such as further strength agents and/or flocculants, as well as retention aids, drainage aids, biocides, defoamers, brightening agents, colours, sizing agents, fixatives, coagulants, or any combinations thereof, may be added to the cellulose fibre suspension at any time before the headbox.

Suitable amounts of each of the cationic GPAM, inorganic siliceous microparticles and other possible components will depend on the particular component, the composition of the paper or paperboard being manufactured, the properties of the fibre suspension including but not limited to dissolved calcium ion concentration, cationic demand, and colloidal load as measured by filtered turbidity, and like considerations, and are readily determined without undue experimentation in view of the present disclosure and common general knowledge of a skilled person. According to an embodiment of the invention, the glyoxalated copolymer of acrylamide and cationic monomers is added in an amount from about 0.025% to about 1.0%, such as from about 0.1% to about 0.9%, dry solids based on dry weight of the cellulosic fiber suspension. According to an embodiment of the invention, the bentonite may be added in an amount from about 0.05% to about 0.5%, such as from about 0.2 to about 0.3%, dry solids based on dry weight of the cellulosic fibre suspension. According to an embodiment of the invention, the silica sol may be added in an amount from about 0.005% to about 0.20%, such as from about 0.01% to about 0.10%, dry solids based on dry weight of the cellulosic fibre suspension. In a preferred embodiment of the invention, the cationic GPAM is added in an amount from about 0.025% to about 1.0% dry solids based on dry weight of the cellulosic fibre suspension and the silica sol is added in an amount from about 0.005% to about 0.20% dry solids based on dry weight of the cellulosic fibre suspension.

The process of the present disclosure may further comprise adding a fresh filler such as precipitated or ground calcium carbonate, kaolin, talc, or any combinations thereof, in moderate amounts, such as at most 5% on dry weight basis, based on the paper or paperboard. In other embodiments, the process is free of a fresh inorganic filler. The total ash content of the paper or paperboard manufactured may be substantially higher due to the ash originating from the recycled fibre material (e.g. coating pigment and filler) and carried over to the process of the present disclosure.

The additive system of the present disclosure may be added to a cellulose fibre suspension at various papermaking pHs, depending on the application. Typically the additive system of the present disclosure is added to a cellulose fibre suspension at papermaking pH between 4 and 8.5, preferably at papermaking pH between 5 to 8, as measured at the headbox(es) of the paper machine. Typically GPAM performs best in acidic to neutral pH, while inorganic microparticles from neutral to alkaline pH range, and thus the performance of this concept performs optimally in this near neutral pH. FIG. 1 is a schematic diagram illustrating generally a typical paper making system including a blend chest, a machine chest, and white water silo. Typically, different fibre materials, including the recycled fibre material, are blended in a blend chest. In machine chest the cellulosic fibre suspension is in the form of a thick stock having consistency of above 20 g/I. This is metered according to the desired basis weight of the paper or board being manufactured at the basis weight valve, and diluted with circulating waters in the silo. The fibre suspension may then be passed through cleaners and a deculator. Pumps may be used at various stages, such as a blend chest pump after blend chest to deliver blended fibre materials into the machine chest, a machine chest pump to deliver the fibre suspension from machine chest towards white water silo, a cleaner pump to deliver the fibre suspension to the cleaners, and fan pump to deliver the fibre suspension to the headbox, passing through the pressure screens when route to the headbox. The system further comprises head box, former, and tray, followed by press section and dryers. The cleaned and deaerated fibre suspension is delivered to the headbox, drained on a screen to form a wet web of paper or board, and pressed and dried to obtain the paper or paperboard. If the formed wet web is an individual ply of a paperboard, this is combined with other plies being formed simultaneously, and only then pressed and dried.

The diagram of FIG. 1 further illustrates the various points in the papermaking process where the GPAM component of the additive system of the present disclosure ("B" in diagram), may be added prior, post, or simultaneously with the inorganic siliceous microparticle component of the additive system of the present disclosure ("A" in diagram), during the paper making process.

As depicted in FIG. 1, in embodiments, the GPAM may be added directly after blend chest, or directly after machine chest or before or after the basis weight valve, or after the white water silo, or before or after the fan pump, or between the pressure screen and headbox, or using any combination of these addition points. In embodiments, inorganic siliceous microparticles may be added before cleaners, or between cleaners and deculator, or between deculator and fan pump, or between fan pump and pressure screen, or between pressure screen and headbox, or using any combination of these addition points.

According to an embodiment of the invention, the cationic GPAM is added to the fibre suspension prior to the addition of the inorganic siliceous microparticles.

According to an embodiment of the invention, the cationic GPAM is added to the fibre suspension, to thick stock or thin stock (i.e. after the point of thick stock dilution), at any point before the pressure screen, preferably at any point up to the suction side of the fan pump, and the inorganic siliceous microparticles are added to the thin stock at any point after the addition of GPAM.

The cationic GPAM may be added to the fibre suspension, to thick stock, at any point after the machine chest, such as to the suction side of the machine chest pump, up to the point of thick stock dilution to obtain thin stock, and the inorganic siliceous microparticles are added to the thin stock at any point. According to an embodiment of the invention, the GPAM is added to the fibre suspension, to thin stock, at any point before the pressure screen, preferably at any point up to the suction side of the fan pump, and the inorganic siliceous microparticles are added to the thin stock at any point after the addition of GPAM.

The following are examples of preferred addition points of the additive concept of the present disclosure including the optional high molecular weight cationic flocculant:

Preferably GPAM is added to the thick stock at any point after the machine chest, such as to the suction side of the machine chest pump, up to the point of thick stock dilution to obtain thin stock, a high molecular weight cationic polyacrylamide (HMW CPAM) is added to the thin stock (i.e. after the point of thick stock dilution) at any point up to the pressure screen, and bentonite as inorganic siliceous microparticles is added to the thin stock at any point after the pressure screen; GPAM is added to the thick stock at any point after the machine chest, such as to the suction side of the machine chest pump, up to the point of thick stock dilution to obtain thin stock, HMW CPAM is added to the thin stock at any point after the pressure screen, and bentonite as inorganic siliceous microparticles is added to the thin stock at any point up to the pressure screen; or GPAM is added to the thin stock (i.e. after the point of thick stock dilution) at any point before the pressure screen, preferably at any point up to the suction side of the fan pump, HMW CPAM is added to the thin stock at any point up to the pressure screen, and bentonite as inorganic siliceous microparticles is added to the thin stock at any point after the pressure screen; or GPAM is added at any point to the thin stock before the pressure screen, preferably at any point up to the suction side of the fan pump, HMW CPAM is added to the thin stock at any point after the pressure screen, and bentonite as inorganic siliceous microparticles is added to the thin stock at any point up to the pressure screen. Alternatively GPAM is added to the thin stock at any point after the pressure screen, before HMW CPAM, HMW CPAM is added to the thin stock at any point after the pressure screen, and bentonite as inorganic siliceous microparticles is added to the thin stock at any point up to the pressure screen.

Preferably GPAM is added to the thick stock at any point after the machine chest, such as to the suction side of the machine chest pump, up to the point of thick stock dilution to obtain thin stock, a high molecular weight cationic polyacrylamide (HMW CPAM) is added to the thin stock (i.e. after the point of thick stock dilution) at any point up to the pressure screen, and silica sol as inorganic siliceous microparticles is added to the thin stock at any point after the pressure screen; GPAM is added to the thick stock at any point after the machine chest, such as to the suction side of the machine chest pump, up to the point of thick stock dilution to obtain thin stock, HMW CPAM is added to the thin stock at any point after the pressure screen, and silica sol as inorganic siliceous microparticles is added to the thin stock at any point up to the pressure screen; or GPAM is added to the thick stock at any point after the machine chest, such as to the suction side of the machine chest pump, up to the point of thick stock dilution to obtain thin stock, HMW CPAM is added to the thin stock at any point after the pressure screen, and silica sol as inorganic siliceous microparticles is added to the thin stock at any point after the pressure screen, after the HMW CPAM; or GPAM is added to the thin stock (i.e. after the point of thick stock dilution) at any point before the pressure screen, preferably at any point up to the suction side of the fan pump, HMW CPAM is added to the thin stock at any point up to the pressure screen, and silica sol as inorganic siliceous microparticles is added to the thin stock at any point after the pressure screen; or GPAM is added at any point to the thin stock before the pressure screen, preferably at any point up to the suction side of the fan pump, HMW CPAM is added to the thin stock at any point after the pressure screen, and silica sol as inorganic siliceous microparticles is added to the thin stock at any point up to the pressure screen; or GPAM is added at any point to the thin stock before the pressure screen, preferably at any point up to the suction side of the fan pump, HMW CPAM is added to the thin stock at any point after the pressure screen, and silica sol as inorganic siliceous microparticles is added to the thin stock at any point after the pressure screen, after HMW CPAM.

The following Examples are provided to illustrate, but not to limit, the features of the present disclosure so that those skilled in the art may be better able to practice the features of the disclosure described herein.

Example 1

Glyoxylated polyacrylamide (GPAM) and silica sol were evaluated in conjunction, using a low consistency, less than 1% solids, cellulosic stock suspension of 100% recycled fibre (Old Corrugated Container (OCC)) synthesized from very low consistency process white water and high consistency thick stock. The consistency was about 0.1% and 4.5% solids, respectively. The white water was collected from the paper machine tray below the moving wire of the paper machine and the thick stock from the stock approach of the paper machine process. At the time of sample collection, the conductivity at the headbox was about 2500 μS (microsiemens)/cm.

Two cationic GPAM polymers, a standard charge double structured cationic GPAM (GPAM 1), and a high charged cationic GPAM (GPAM 2), were evaluated. A description of the GPAM polymers is shown in Table 1.

TABLE 1

| | Standard charged double structured GPAM 1 | High charged GPAM 2 |
|---|---|---|
| GPAM charge density, meq/dry gram | 0.4 | 1.6 |
| GPAM weight-average molecular weight, Mg/mol | >1 | >1 |

The GPAM polymers were evaluated in conjunction with various silica sol technologies having different specific surface areas and structures, as determined by S-value. A description of the properties of the silica sols evaluated is shown in Table 2.

TABLE 2

| | Silica 1 | Silica 2 | Silica 3 | Silica 4 | Silica 5 |
|---|---|---|---|---|---|
| S-Value (%) | ≥50 | <30 | <20 | <35 | 35 |
| SSA ($m^2/g$) | ≤500 | ≥800 | >1000 | ≥900 | 700 |

Application rates of the cationic GPAMs and silica sols were 3, 6, and 9 dry pounds/dry paper ton, and 0.5, 1.0, 1.5 dry pounds/dry paper ton, respectively. A linear high molecular weight cationic polyacrylamide (HMW CPAM) retention aid was applied to all samples at an application rate of 0.35 dry pounds per ton. For each experiment, drainage efficiency and colloidal retention were determined.

Drainage efficiency was determined using a Dynamic Drainage Analyzer (DDA). This device determined the drainage rate of liquid from a low consistency cellulosic pulp suspension (typically less than 1% solids) under vacuum. A drainage time was determined in seconds. Lower drainage times indicated more efficient dewatering or drainage, which is desirable.

Figure 2:
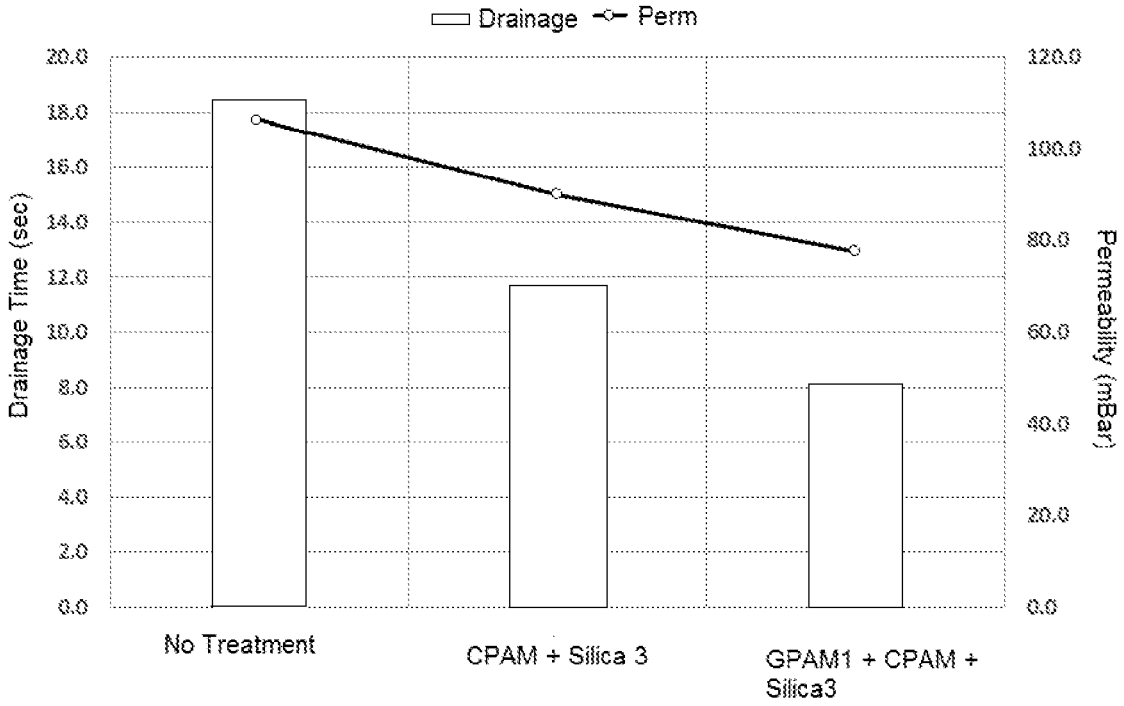
FIG. 2 is a graph of the drainage efficiency data of Example 1 employing a HMW cationic polyacrylamide combined with highly structured silica sol of a high specific surface area.
Figure 3:
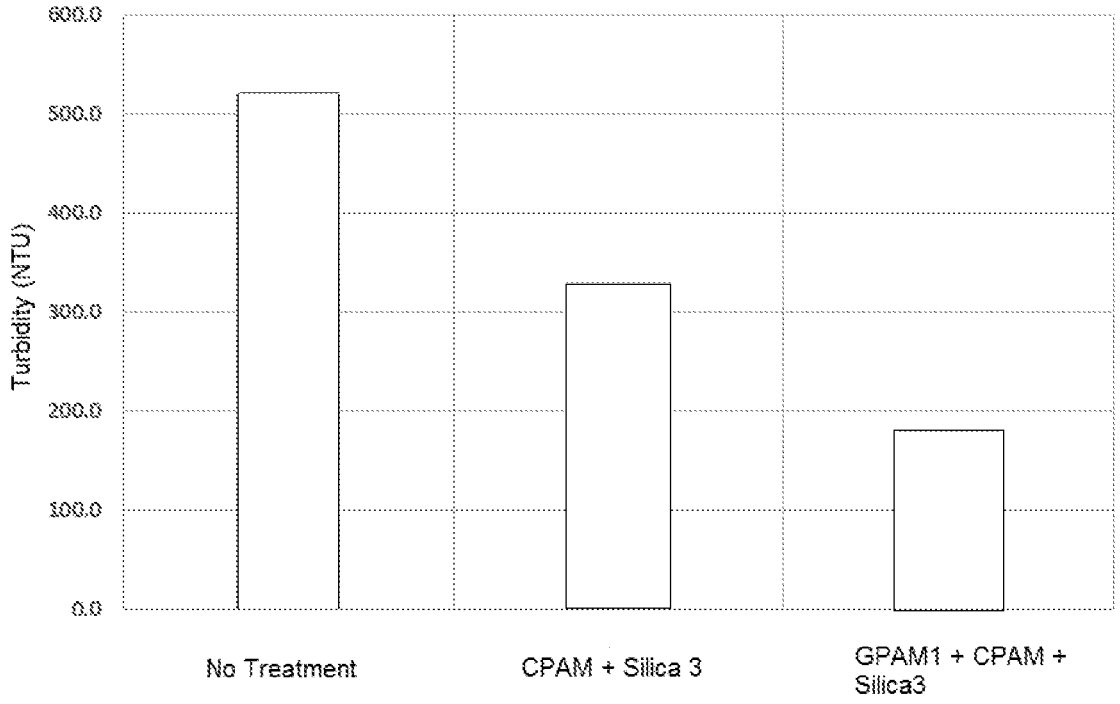
FIG. 3 is a graph of the superior colloidal retention data, as measured by turbidity of Example 1 employing the combined program of CPAM/Silica 3 with GPAM 1 over silica sol and CPAM alone.

The drainage efficiency data when employing a HMW cationic polyarcrylamide (CPAM) with Silica 3 is illustrated in FIG. 2. Silica 3 is a high specific surface area (SSA), highly structured silica sol, characterized by low S-value. The data compares the performance of the CPAM and Silica 3 system with and without the inclusion of a standard charged double structured GPAM (GPAM 1). The data shows that the addition of the standard charged double structured GPAM (GPAM 1) can significantly improve drainage efficiency over the CPAM/Silica 3 program alone, indicated by a reduction in drainage time of over 30%. The permeability data also shows this trend. In addition, FIG. 3 demonstrates the superior colloidal retention, as measured by turbidity (lower is better), of the combined program of CPAM/Silica 3 with GPAM 1 over silica sol and CPAM alone. The inclusion of GPAM 1 provides a turbidity reduction of over 45%.

In addition to the drainage time (lower indicates more efficient dewatering), the permeability data is also shown. Lower values in permeability indicate a dryer pad, which points to more efficient dewatering or drainage.

The colloidal retention was determined by turbidity measurement on the filtrate drained from the cellulosic stock suspension generated in the DDA drainage test. The lower turbidity values indicated better colloidal retention, which is desirable.

The DDA Mixer was also used to prepare the stock with the various additives described above. Approximately 750 ml of stock was mixed at 1000 RPM with the additives applied in the sequence summarized below in Table 3.

TABLE 3

| Time | Action |
|---|---|
| −45 seconds | Start mixing at 1000 revolutions per minute (RPM) |
| −35 seconds | Add GPAM |
| −25 seconds | Add HMW CPAM |
| −10 seconds | Add silica sol |
| 0 seconds | Stop mixing (RPM = 0); start drainage test |

Figure 4:
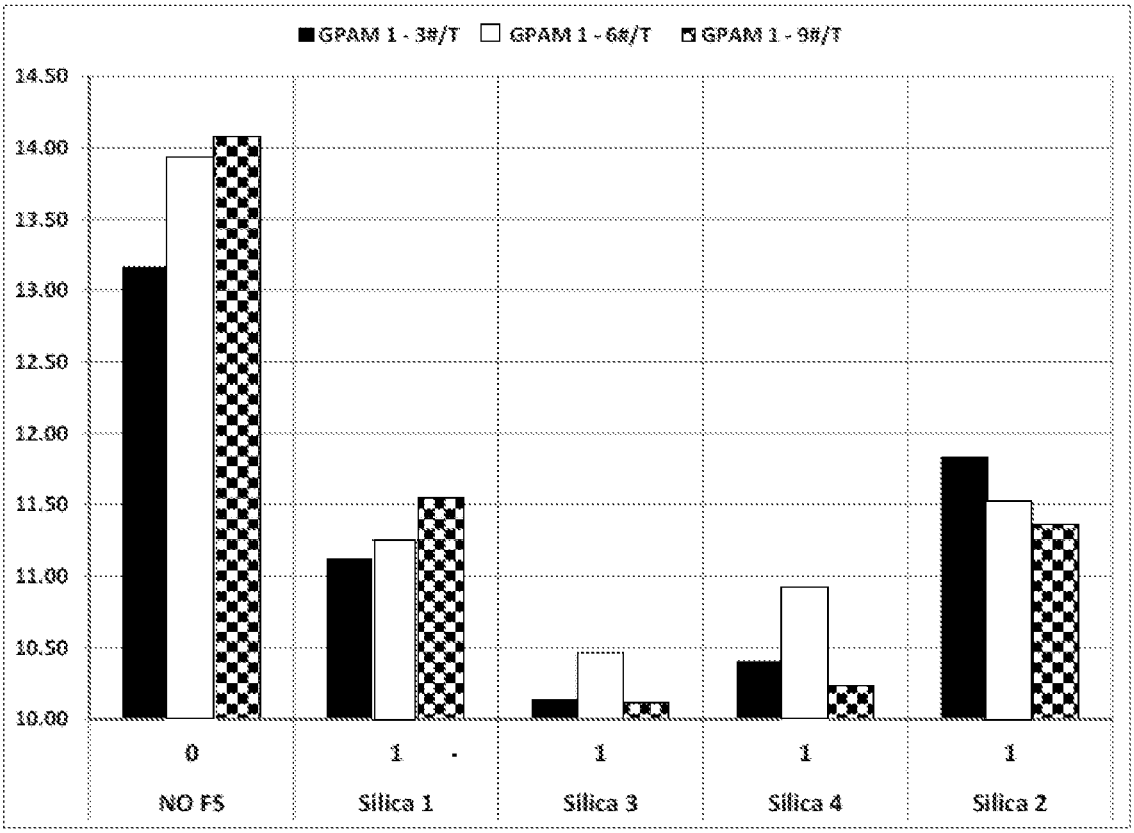
FIG. 4 is a graph of the drainage efficiency data of Example 1 employing a standard charged double structure GPAM (GPAM 1) combined with four silica sols of different SSA's and S-values.

The drainage efficiency data when using a standard charged double structure GPAM (GPAM 1) are illustrated in FIG. 4. Various silica sols were evaluated with the GPAM 1, at the amounts of GPAM noted above (3 dry pounds per ton, 6 dry pounds per ton, and 9 dry pounds are ton). The data illustrates that high surface area, highly structured silica sols, characterized by their low S-value, or high specific surface area (SSA) silica sols, can significantly improve drainage efficiency (over no silica) at much lower application rates than standard charged double structured GPAM combinations with lower surface area less structured silica sols. Moreover, GPAM combinations with the high SSA, low S-value sols, were able to achieve efficiencies that the lower SSA, lower structured silica sols could not attain at any elevated dose.

Figure 5:
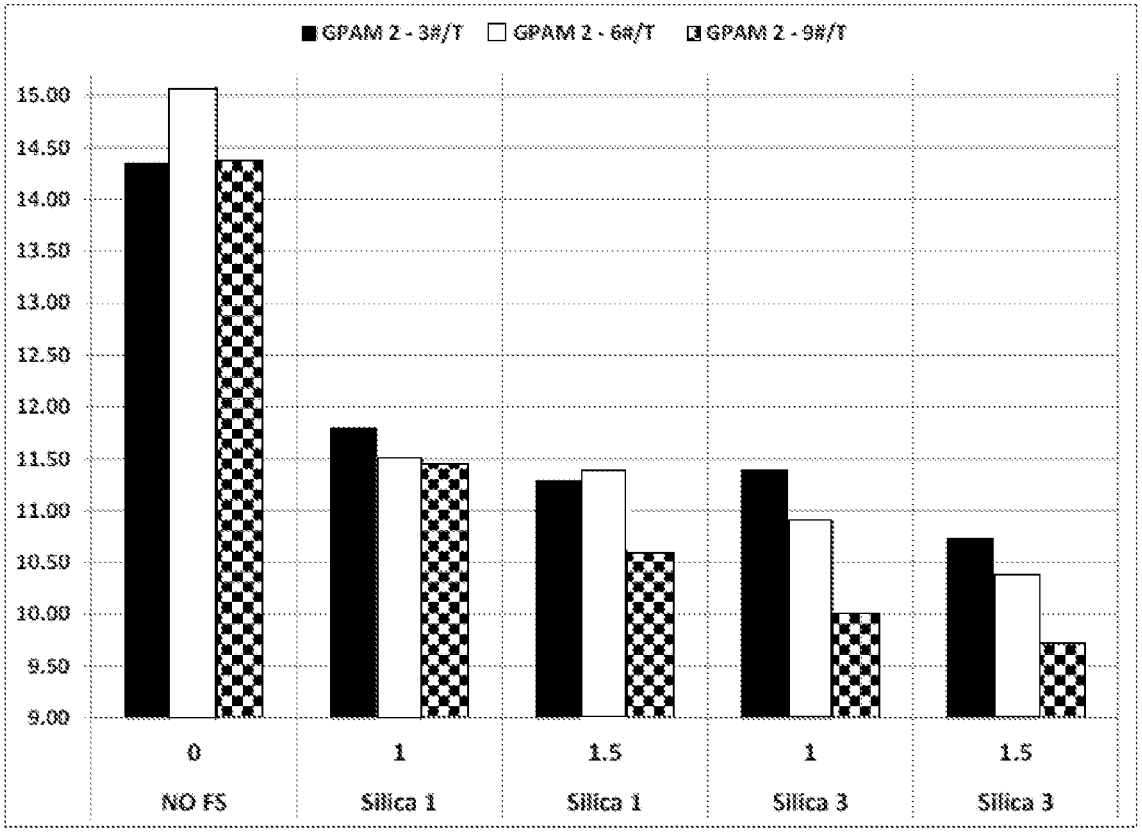
FIG. 5 is a graph of the drainage efficiency data of Example 1 employing a high charged GPAM (GPAM 2) combined with two silica sols of different SSA's and S-values.

The drainage efficiency data for an additive concept using high charged GPAM (GPAM 2) are illustrated in FIG. 5. High SSA, highly structured (low S-value) Silica 3 and low SSA low structured (high S-value) Silica 1, were evaluated with GPAM 2 at the amounts of GPAM noted above (3 dry pounds per ton, 6 dry pounds per ton, and 9 dry pounds are ton). FIG. 5 illustrates that a very steep increase in drainage efficiency (lower drainage time values) was observed with the addition of any silica sol, even at the lowest dosage. Drainage efficiency continued to improve with both silica sols, in similar fashion, indicating that a wide range of silica properties, including S-value and surface area, interacted very efficiently and similarly, with the high charged GPAM (GPAM 2).

Figure 6:
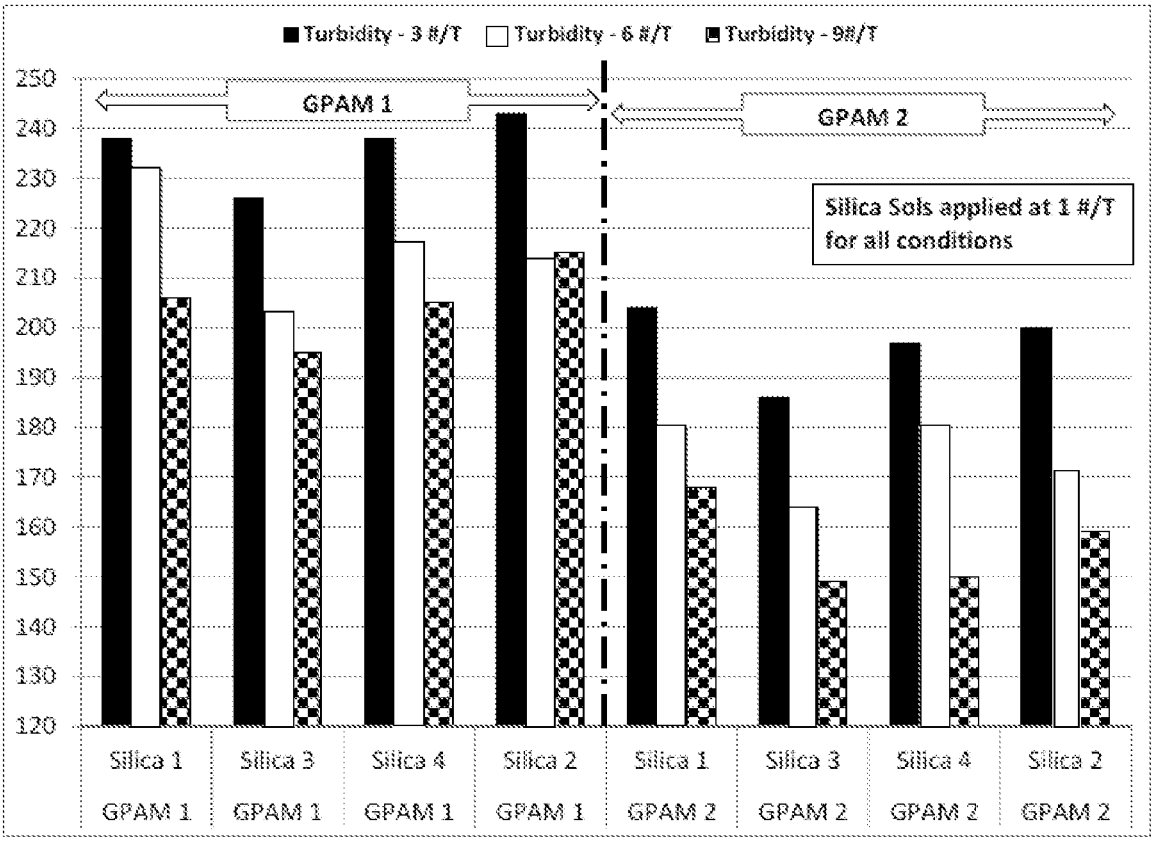
FIG. 6 is a graph comparing the colloidal retention data of Example 1 employing GPAM 1 or GPAM 2 with four silica sols of different SSA's and S-values.

FIG. 6 compares the colloidal retention data obtained for the standard charge double structure GPAM (GPAM 1), with the high charged GPAM (GPAM 2). (The data compares the two GPAM products with three dosages with the various silica sols of varying SSA and S-value per Table 2). Lower turbidity values indicate better colloidal retention. As depicted in FIG. 4, the data indicated the use of any silica sol with GPAM 2 provided colloidal retention that was unmatched by any silica sol applied with GPAM 1, including the very high SSA, very highly structured/very low S-value, Silica 3.

Example 2

GPAM and silica sol were evaluated in conjunction with non-thermosetting polyamidoamine epichlorohydrin, using a low consistency, less than 1% solids, cellulosic stock suspension of 100% recycled fibre (Old Corrugated Container (OCC)) synthesized from very low consistency process white water and high consistency thick stock. The consistency was about 0.02% and 4.3% solids, respectively. The white water was collected from the paper machine tray below the moving wire of the paper machine and the thick stock from the stock approach of the paper machine process. At the time of sample collection, the conductivity at the headbox was about 2000 μS (microsiemens)/cm.

A standard charged double structured cationic GPAM (GPAM 1), was evaluated in conjunction with a non-thermosetting (NTS) polyamidoamine epichlorohydrin (PAE), where GPAM 1 is premixed or co-mixed with the NTS PAE prior to application. A description of the GPAM 1 polymer is shown in Table 1.

The GPAM 1 polymer premix with the NTS PAE was evaluated in conjunction with two silica sol technologies having different SSA and structures, as determined by S-value, Silica 3 and Silica 5. A description of the properties of the silica sols evaluated is shown in Table 2.

A linear HMW cationic polyacrylamide (CPAM) was also used in the program evaluation and evaluated at two levels—0.33 dry #/T and 0.62 dry #/T. The standard charged double structured GPAM (GPAM 1) was applied at 5 Dry #/T with the NTS PAE at 2 Dry #/T in a premix. The two silica sols were applied at ranges between 0.25-1.0 Dry #/T.

The mixing sequence for the stock preparation is shown in Table 4 below.

TABLE 4

| Time | Action |
|---|---|
| 0 sec | Start Impeller RPM = 1200 |
| 18 sec | Add GPAM + NTS PAE |
| 28 sec | Add CPAM |
| 30 sec | Add Silica Sol |
| 40 sec | Sample |

Drainage efficiency was determined using a Dynamic Drainage Analyzer (DDA). In addition to the drainage time (lower indicates more efficient dewatering), the permeability data is also shown. Lower values in permeability indicate a dryer pad, which points to more efficient dewatering or drainage.

Figure 7:
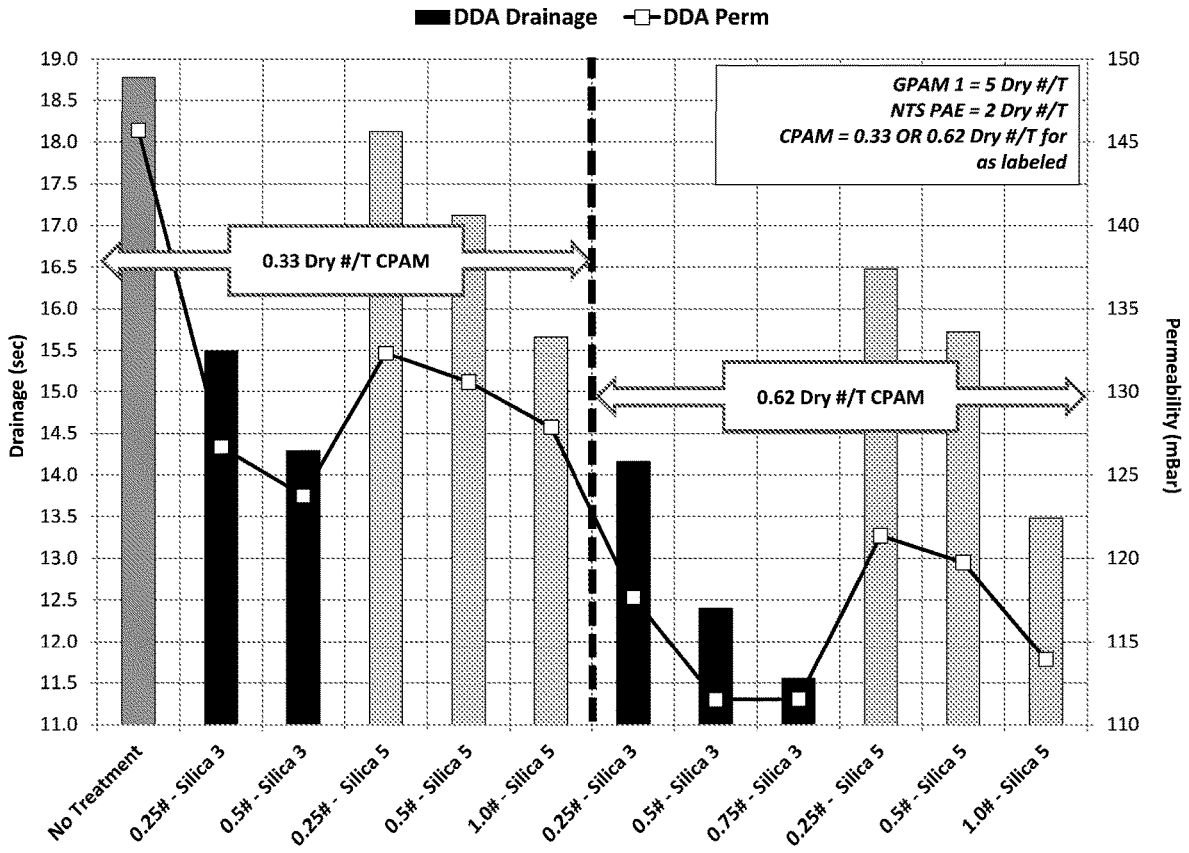
FIG. 7 is a graph of drainage efficiency data of Example 2 employing a premix of GPAM 1 and a non-thermosetting (NTS) polyamidoamine epichlorohydrin (PAE) with two silica sols of different SSA's and S-values.

The drainage data is illustrated in FIG. 7. The data shows that with the premix application of the GPAM 1 with the NTS PAE, when used in conjunction with silica sol, the high SSA, low S-value (highly structured) Silica 3 clearly outperform systems employing a moderately structured, moderate SSA Silica 5. This difference is observed at two application levels of CPAM. The data indicates that it takes up to four (4) times the dry silica sol dosage of the moderate surface area moderate structured silica sol to match the efficiency of the high SSA highly structured silica sol.

Example 3

An industrial evaluation was done on a two ply Fourdrinier paper machine producing thirty-five (35) pound per thousand square feet (lb/1000 ft2) high performance liner board using 100% Old Corrugated Container (OCC) furnish. The basis weight split between the top and bottom ply were 30% and 70%, respectively. The pH at the headbox was about 6.9 and the conductivity (measured at the headbox) was about 2550 μS/cm. A standard charge double structured cationic GPAM (GPAM 1) was evaluated in conjunction with a non-thermosetting (NTS) polyamidoamine epichlorohydrin (PAE), where the standard charged GPAM (GPAM 1) was premixed or commixed with the NTS PAE prior to application at the suction of the machine chest pump of the process. Two silica sol technologies having different specific surface areas and structures, as determined by S-value, were evaluated. A description of the GPAM and silica sols used in the evaluation can be found in Table 1 and Table 2, respectively. The silica sols were applied at the post pressure screen. A high molecular weight (HMW) linear cationic polyacrylamide (CPAM) was also employed in the program evaluation. The HMW CPAM was applied at the inlet of the pressure screen. Table 5 shows the application rates for the various additives.

TABLE 5

| Additive | Silica Sol 5 System | Silica Sol 3 System |
|---|---|---|
| NTS PAE | 1.2 Dry #/T | 1.2 Dry #/T |
| GPAM 1 | 6.2 Dry #/T | 6.2 Dry #/T |
| HMW CPAM | 0.38 Dry #/T | 0.37 Dry #/T |
| Silica Sol | 0.7 Dry #/T Silica 5 | 0.5 Dry #/T Silica 3 |

The additive levels were essentially the same for all the additives with the exception of the silica sols, where the application rate of the Silica 3 was about 28% lower than the Silica 5.

Figure 8:
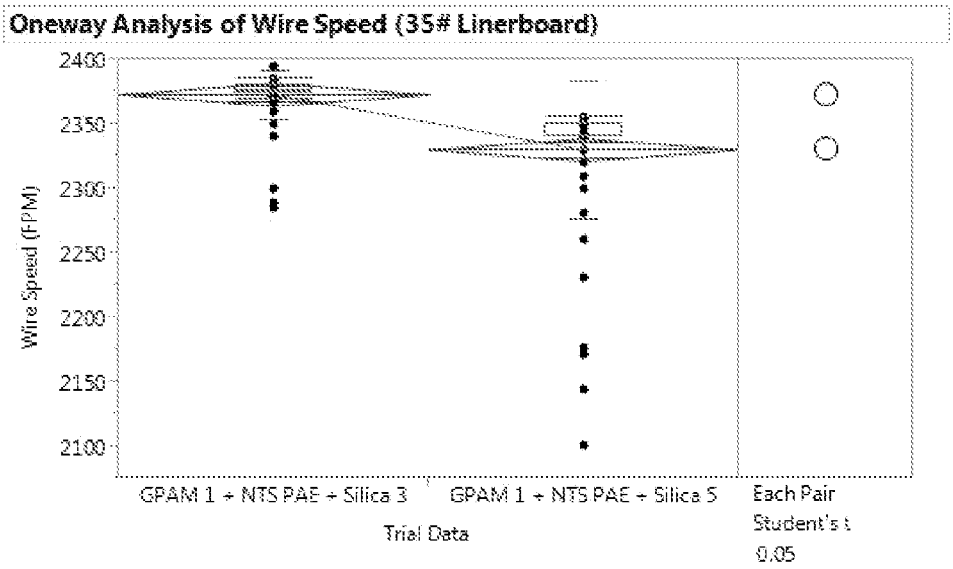
FIG. 8 displays a one way analysis of variance (ANOVA) for the productivity data in terms of machine speed for two ply Fourdrinier paper machine of Example 3 employing a premix of GPAM 1 and a non-thermosetting (NTS) polyamidoamine epichlorohydrin (PAE) applied at the suction of the machine chest pump and HMW CPAM applied at the inlet of the pressure screen, with two silica sols of different SSA's and S-values applied post pressure screen.

FIG. 8, displays the one way analysis of variance (ANOVA) for the productivity data in terms of machine speed via the speed of the wire turning roll for each program. Also shown in the figure (circles to the right) is a comparison of the student t-statistic for each data set. The data shows that with the GPAM 1 and NTS PAE program employing the high SSA, highly structured silica sol (low S-value), Silica 3, there is about a 1% increase in speed which is statistically significant at a 95 confidence level, indicated by the separation of the t-statistic circles. The increase in speed occurs at the 28% lower dosage of Silica 3 compared to the dosage of the moderate SSA, moderate structured Silica 5.

Figure 9:
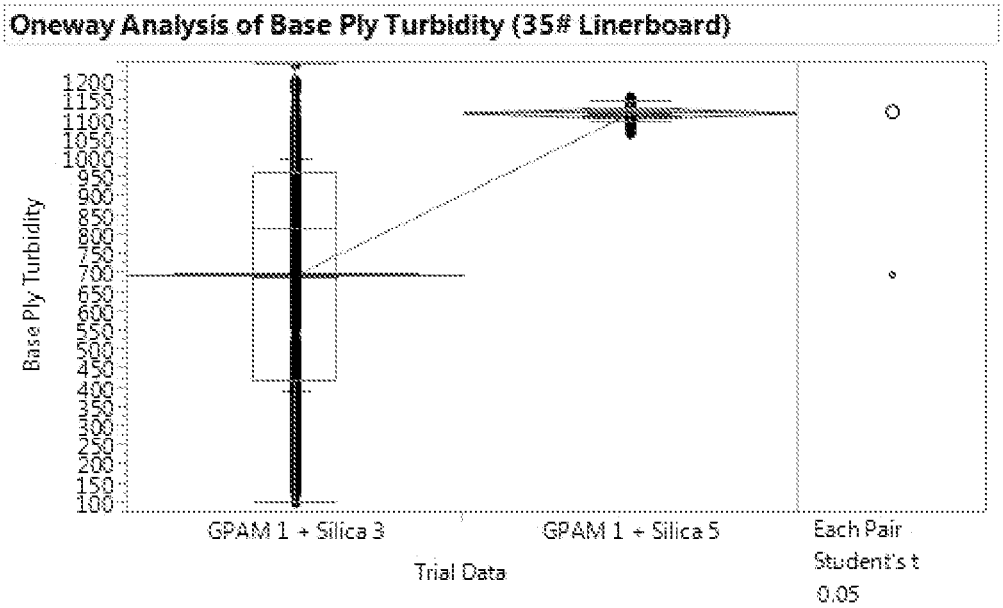
FIG. 9 displays a one way analysis of variance (ANOVA) for the colloidal retention data for two ply Fourdrinier paper machine of Example 3 employing a premix of GPAM 1 and a non-thermosetting (NTS) polyamidoamine epichlorohydrin (PAE) applied at the suction of the machine chest pump and HMW CPAM applied at the inlet of the pressure screen, with two silica sols of different SSA's and S-values applied post pressure screen.

FIG. 9 shows the colloidal retention data via turbidity measurement on the wire water (tray water). One way ANOVA analysis shows that the mean turbidity of the system when using a high SSA, low S-value Silica 3 program, shows a statistically significant decrease of over 37% (at a 95% confidence level) compared to the program using the moderate SSA, moderate structure Silica 5, illustrating the superior colloidal retention properties when using the system employing Silica 3 instead of Silica 5.

Figure 10:
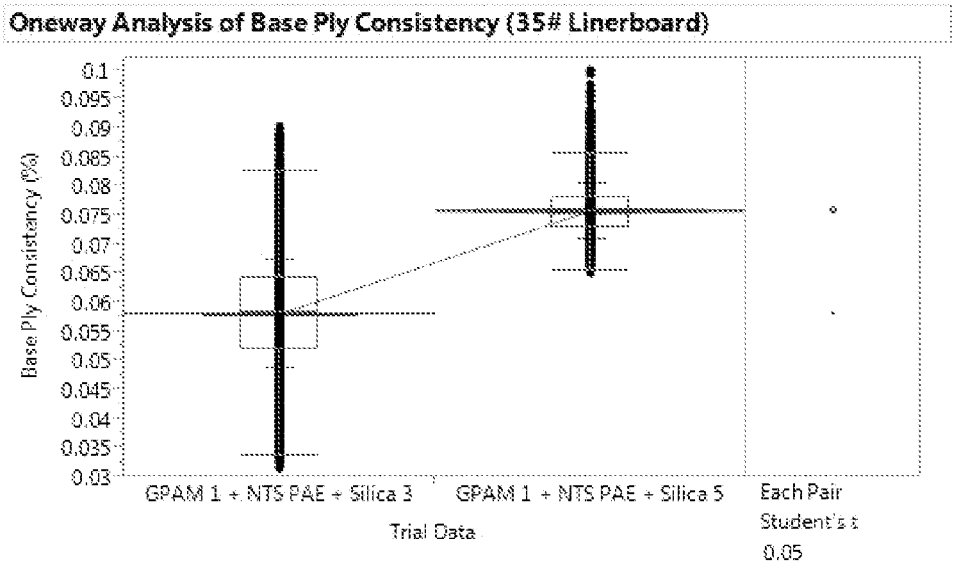
FIG. 10 displays a one way analysis of variance (ANOVA) for the solids retention data for two ply Fourdrinier paper machine of Example 3 employing a premix of GPAM 1 and a non-thermosetting (NTS) polyamidoamine epichlorohydrin (PAE) applied at the suction of the machine chest pump and HMW CPAM applied at the inlet of the pressure screen, with two silica sols of different SSA's and S-values applied post pressure screen.

FIG. 10 shows a similar one way ANOVA of the retention data, as measured by the consistency (solids) of the wire water (tray water) for the two silica programs. The data shows the improved solids retention, indicated by the lower solids in the wire water, when the high SSA, highly structured silica sol is employed with the GPAM 1 and NTS PAE program. A statistically significant reduction of 23% of the wire water solids (at a 95% confidence level) was realized with a lower dose of the Silica 3 compared to the GPAM 1 and NTS PAE program employing the moderate structured moderate SSA Silica 5.

Example 4

An industrial evaluation was done on a two ply Fourdrinier paper machine producing forty-two (42) pound per thousand square feet (lb/1000 ft2) liner board using 100% Old Corrugated Container (OCC) furnish. The basis weight split between the top and bottom ply were 30% and 70%, respectively. The pH at the headbox was about 6.9 and the conductivity (measured at the headbox) was about 2400 μS/cm. A standard charge double structured cationic GPAM (GPAM 1) was applied at the suction of the machine chest pump of the process. Two silica sol technologies having different specific surface areas and structures, as determined by S-value, were evaluated with the GPAM. A description of the GPAM and silica sols used in the evaluation can be found in Table 1 and Table 2, respectively. The silica sols were applied post pressure screen. A high molecular weight (HMW) linear cationic polyacrylamide (CPAM) was also employed in the program evaluation. The HMW CPAM was applied at the inlet of the pressure screen. Table 6 shows the application rates for the various additives.

TABLE 6

| Additive | Silica Sol 5 System | Silica Sol 3 System |
|---|---|---|
| GPAM 1 | 5.7 Dry #/T | 5.7 Dry #/T |
| HMW CPAM | 0.24 Dry #/T | 0.23 Dry #/T |
| Silica Sol | 0.7 Dry #/T Silica 5 | 0.5 Dry #/T Silica 3 |

The additive levels were essentially the same for all the additives with the exception of the silica sols, where the application rate of the Silica 3 was about 28% lower than the Silica 5.

Figure 11:
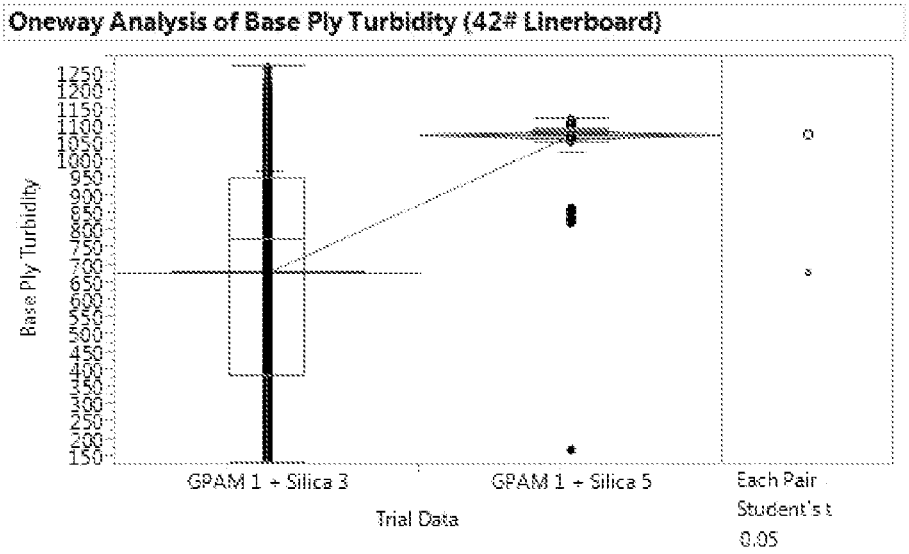
FIG. 11 displays a one way analysis of variance (ANOVA) for the colloidal retention data for two ply Fourdrinier paper machine of Example 4 employing GPAM 1 applied at the suction of the machine chest pump and HMW CPAM applied at the inlet of the pressure screen, with two silica sols of different SSA's and S-values applied post pressure screen.

FIG. 11 shows the colloidal retention data via turbidity measurement on the wire water (tray water). One way ANOVA analysis shows that the mean turbidity of the system when using a high SSA, low S-value Silica 3 program, shows a statistically significant decrease of 37% (at a 95% confidence level) compared to the program using the moderate SSA, moderate structure Silica 5, illustrating the superior colloidal retention properties when using a system employing Silica 3 instead of Silica 5.

Figure 12:
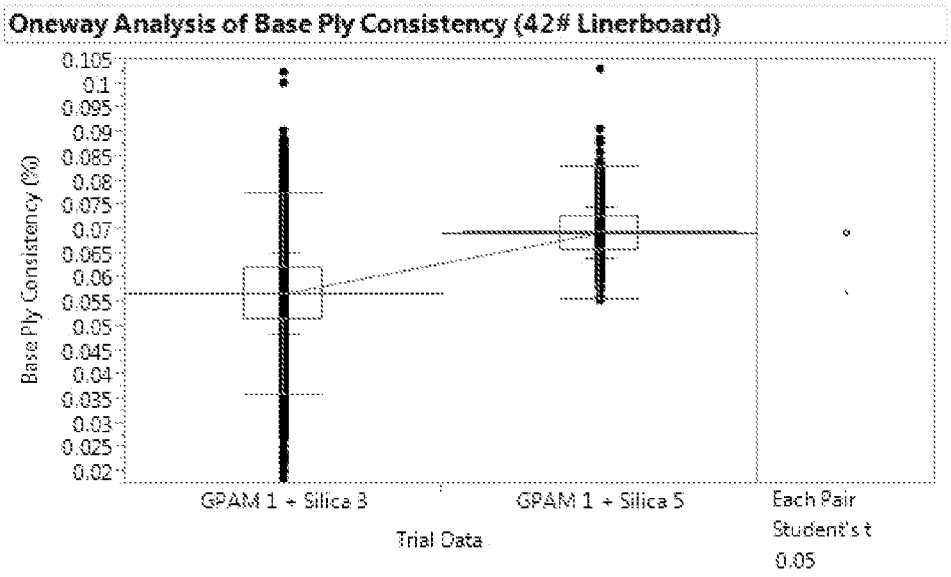
FIG. 12 displays a one way analysis of variance (ANOVA) for the solids retention data for two ply Fourdrinier paper machine of Example 4 employing GPAM 1 applied at the suction of the machine chest pump and HMW CPAM applied at the inlet of the pressure screen, with two silica sols of different SSA's and S-values applied post pressure screen.

FIG. 12 shows a similar one way ANOVA of the retention data, as measured by the consistency (solids) of the wire water (tray water) for the two silica programs. The data shows the improved solids retention, indicated by the lower solids in the wire water, when the high SSA, highly structured silica sol is employed with the GPAM 1 program. A statistically significant reduction of 18% of the wire water solids (at a 95% confidence level) was realized with a lower dose of the Silica 3 compared to the GPAM 1 program employing the moderate structured moderate SSA Silica 5.

Example 5

An industrial evaluation was done on a single ply Fourdrinier paper machine producing thirty-six (36) pound per thousand square feet (lb/1000 ft2) medium (board) using 100% Old Corrugated Container (OCC) furnish. The pH at the headbox was about 6.7 and the conductivity (measured at the headbox) was about 3150 μS/cm. Two cationic GPAM polymers, a standard charge double structured cationic GPAM (GPAM 1), and a high charged cationic GPAM (GPAM 2), were evaluated. A description of the GPAM polymers is shown in Table 1.

The GPAM polymers were applied at the suction of the machine chest pump of the process. A high SSA high structured (low S-value) silica sol, Silica 3, was evaluated with the two different GPAM polymers. The silica sol was applied post pressure screen. A description of the silica sol can be found in Table 2. A high molecular weight (HMW) linear cationic polyacrylamide (CPAM) was also employed in the program evaluation. The HMW CPAM was applied at the inlet of the pressure screen. In addition, the GPAM 1 was evaluated without the silica sol (in addition to running with the silica sol). Table 7 shows the application rates for the various additives.

TABLE 7

| Additive | GPAM 1 No Silica Sol System | GPAM 1 + Silica Sol 3 System | GPAM 2 + Silica Sol 3 System |
|---|---|---|---|
| GPAM 1 | 4.8 Dry #/T | 6.0 Dry #/T | 0 |
| GPAM 2 | 0 | 0 | 6.0 Dry #/T |

TABLE 7-continued

| Additive | GPAM 1 No Silica Sol System | GPAM 1 + Silica Sol 3 System | GPAM 2 + Silica Sol 3 System |
|---|---|---|---|
| HMW CPAM | 0.2 Dry #/T | 0.2 Dry #/T | 0.2 Dry #/T |
| Silica Sol 3 | 0 | 0.5 Dry #/T | 0.5 Dry #/T |

It should be noted that for the system not employing Silica Sol 3, the GPAM dosage is 20% lower than the two systems using Silica Sol 3 with either GPAM 1 or GPAM 2. Without the extra colloidal retention contribution from the Silica Sol 3, the systems maximum efficiency was achieved at 4.8 dry #/T. Beyond this application rate, in the absence of the high SSA and low S-value, any added benefit was not cost effective with respect to productivity and strength parameters of the board produced. When the Silica Sol 3 was introduced to the GPAM 1 system, the dosage response with GPAM 1 increased in a viable way. This increased efficiency then carried through to the GPAM 2 application.

Figure 13:
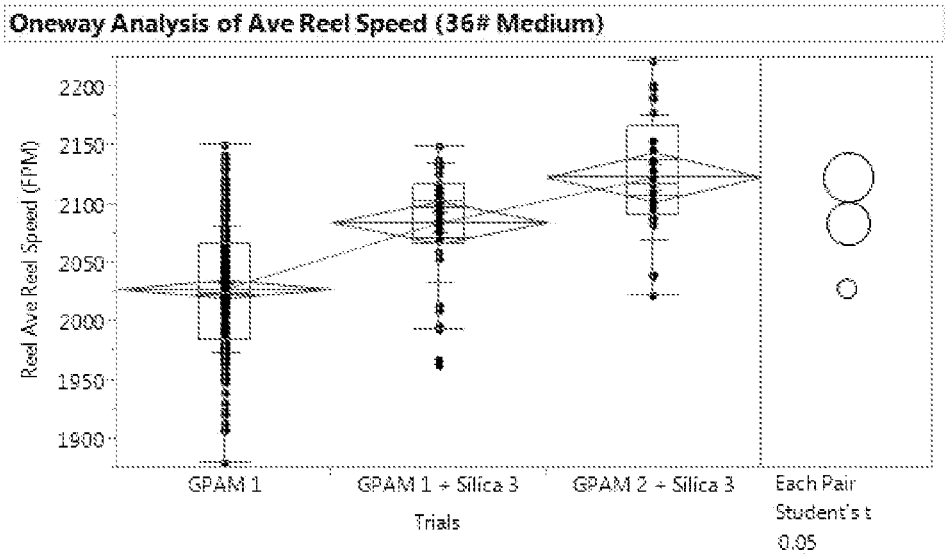
FIG. 13 displays a one way analysis of variance (ANOVA) for the productivity data in terms of machine speed for single ply Fourdrinier paper machine of Example 5 employing GPAM 1 or GPAM 2 applied at the suction of the machine chest pump and HMW CPAM applied at the inlet of the pressure screen, with a silica sol applied post pressure screen.

FIG. 13 displays the one way analysis of variance (ANOVA) for the productivity data in terms of machine speed via the reel speed for each of the three (3) programs. Also shown in the figure (circles to the right) is a comparison of the student t-statistic for each data set. The data shows that when high SSA silica sol with low S-value, Silica 3, is introduced to the GPAM, higher machine speeds were attainable, indicated by a statistically significant increase of 2.8%. When the high charged GPAM 2 replaced the standard charged double structured GPAM 1 with the application of Silica 3, productivity increased an additional 1.9%.

Figure 14:
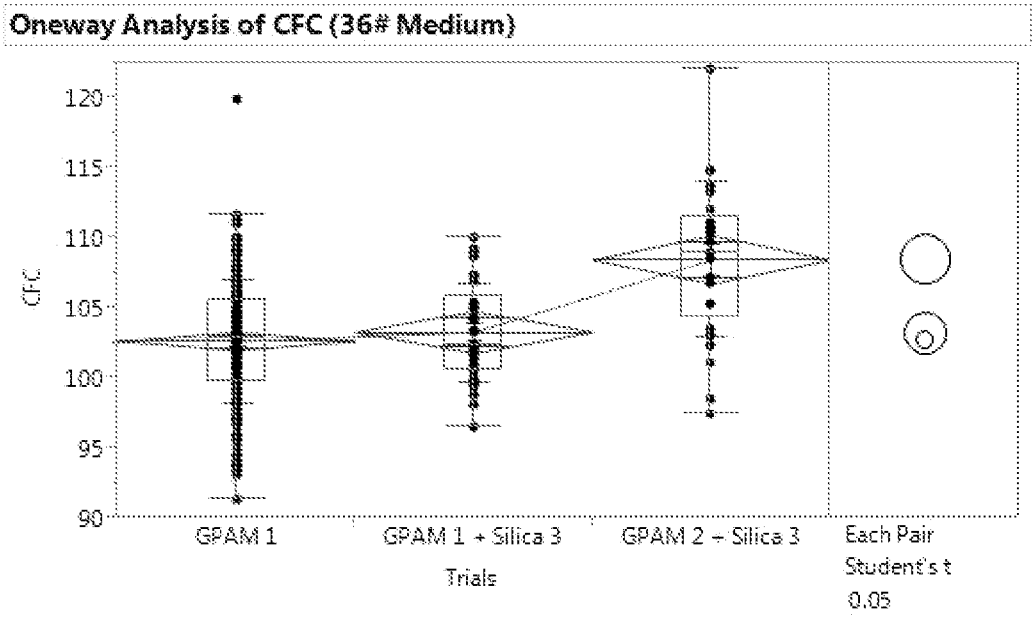
FIG. 14 displays a one way analysis of variance (ANOVA) for the strength data in terms of corrugated fluting compression (CFC) test for single ply Fourdrinier paper machine of Example 5 employing GPAM 1 or GPAM 2 applied at the suction of the machine chest pump and HMW CPAM applied at the inlet of the pressure screen, with one silica sol applied post pressure screen.

FIG. 14 shows the one way analysis of variance (ANOVA) for the board strength in terms of the corrugated fluting compression (CFC) test for each of the three (3) programs. The data shows that there is not a significant increase in strength when the high SSA, low S-value, Silica 3, was introduced to the GPAM 1 system. This is partially due to the fact that the added efficiency of the Silica 3 addition was used for increased productivity (recall FIG. 11). With the inclusion of the high charged GPAM (GPAM2) there is a statistically significant increase in CFC strength of 5.9%, in addition to increased productivity observed in FIG. 13.

While the present disclosure has been described with reference to some embodiments, it will be understood by those skilled in the art that various changes can be made and equivalents can be substituted for elements thereof without departing from the scope of the present disclosure. In addition, modifications can be made to adapt a particular situation or material to the teachings herein without departing from the scope thereof. Therefore, it is intended that the present disclosure not be limited to any particular embodiment disclosed herein, but that the present disclosure includes all embodiments falling within the scope of both what is disclosed herein and the appended claims.

The invention claimed is:

1. A process for making paper or paperboard comprising
providing a cellulosic fibre suspension;
optionally diluting the fibre suspension;
delivering the fibre suspension to a headbox, draining the fibre suspension on a screen to form a wet web of paper, or paperboard;
wherein the cellulosic fibre suspension comprises at least 40% on dry weight basis, based on the paper or paperboard, of recycled fibre material, and has a conductivity of at least 1.5 mS/cm as measured at the headbox of the paper, or paperboard, adding a high molecular weight cationic flocculant to the fibre suspension, wherein the high molecular weight cationic flocculant comprises a copolymer of acrylamide and cationic monomers; and wherein a glyoxalated copolymer of acrylamide and cationic monomers having a weight-average molecular weight in a range of 1 000 000-5 000 000 g/mol, and a charge density over 0.2 meg/g (dry basis) as measured by Mutek charge titration at pH 4.0, and inorganic siliceous microparticles comprising silica sol having a degree of aggregation defined by an S-value of less than 20%, and a specific surface area of at least 1000 $m^2/g$, are added to the fibre suspension sequentially or simultaneously.

2. The process of claim 1, wherein the cellulosic fibre suspension comprises at least 50%, on dry weight basis, based on the paper, or paperboard of the recycled fibre material.

3. The process of claim 2, wherein the cellulosic fibre suspension comprises at least 60%, on dry weight basis, based on the paper, or paperboard of the recycled fibre material.

4. The process of claim 1, wherein the cellulosic fibre suspension has a conductivity of at least 2.0 mS/cm, as measured at the headbox of the paper, or paperboard.

5. The process of claim 1, wherein the recycled fiber material is selected from a group consisting of old corrugated cardboard, mixed office waste, double liner kraft, and any mixtures thereof.

6. The process of claim 1, wherein the glyoxalated copolymer of acrylamide and cationic monomers is added to the fiber suspension before the addition of the inorganic microparticles.

7. The process of claim 1, wherein the glyoxalated copolymer of acrylamide and cationic monomers is added to the fibre suspension having a concentration of above 20 g/l.

8. The process of claim 1, wherein the glyoxalated copolymer of acrylamide and cationic monomers has a charge density in the range of 0.2-3.5 meq/g (dry basis) as measured by Mutek charge titration at pH 4.0.

9. The process of claim 1, wherein the glyoxalated copolymer of acrylamide and cationic monomers has a charge density over 0.8 meq/g.

10. The process of claim 9, wherein the glyoxalated copolymer of acrylamide and cationic monomers has a charge density in a range of 0.8-3.0 meq/g.

11. The process of claim 10, wherein the glyoxalated copolymer of acrylamide and cationic monomers has a charge density in a range of 1.0-2.0 meq/g.

12. The process of claim 11, wherein the glyoxalated copolymer of acrylamide and cationic monomers has a charge density in a range of 1.2-1.8 meq/g.

13. The process of claim 1, wherein the glyoxalated copolymer of acrylamide and cationic monomers is added to the fibre suspension as a blend with a polyamidoamine epihalohydrin.

14. The process of claim 1, wherein the process further comprises adding an anionic acrylamide based flocculant to the fibre suspension, wherein the anionic acrylamide based flocculant comprises a copolymer of acrylamide and acrylic acid, a homopolymer of acrylic acid, or a mixture of a copolymer of acrylamide and acrylic acid and a homopolymer of acrylic acid.

15. The process of claim 1, wherein the glyoxalated copolymer of acrylamide and cationic monomers is added in an amount from 0.025% to 1.0% dry solids based on dry weight of the cellulosic fiber suspension and the silica sol is added in an amount from 0.005% to 0.20% dry solids based on dry weight of the cellulosic fibre suspension.

* * * * *